US009759021B2

(12) United States Patent
Holck et al.

(10) Patent No.: US 9,759,021 B2
(45) Date of Patent: Sep. 12, 2017

(54) RISER HANDLING ON A DRILLING RIG AND A FLIP AND SERVICE MACHINE FOR RISER HANDLING ON A DRILLING RIG

(71) Applicant: Mærsk Drilling A/S, Copenhagen K (DK)

(72) Inventors: Jesper Holck, Humlebæk (DK); Frederik Smidth, Kokkedal (DK); Michael Kannegaard, Espergærde (DK)

(73) Assignee: MAERSK DRILLING A/S, Copenhagen K (DK)

( * ) Notice: Subject to any disclaimer, the term of this patent is extended or adjusted under 35 U.S.C. 154(b) by 0 days.

(21) Appl. No.: 14/891,831

(22) PCT Filed: May 20, 2014

(86) PCT No.: PCT/EP2014/060323
§ 371 (c)(1),
(2) Date: Nov. 17, 2015

(87) PCT Pub. No.: WO2014/187816
PCT Pub. Date: Nov. 27, 2014

(65) Prior Publication Data

US 2016/0090797 A1 Mar. 31, 2016

(30) Foreign Application Priority Data

May 20, 2013 (DK) ..... 2013 00302
Oct. 22, 2013 (DK) ..... 2013 70602

(51) Int. Cl.
*E21B 19/15* (2006.01)
*E21B 19/09* (2006.01)
*E21B 19/08* (2006.01)

(52) U.S. Cl.
CPC ..... *E21B 19/155* (2013.01); *E21B 19/08* (2013.01)

(58) Field of Classification Search
CPC ..... E21B 19/155; E21B 19/08
(Continued)

(56) References Cited

U.S. PATENT DOCUMENTS 3,716,149 A 2/1973 Scaggs
4,033,465 A 7/1977 Stine
(Continued)

FOREIGN PATENT DOCUMENTS

EP 0 174 055 A1 3/1986
EP 0 178 870 A2 4/1986
(Continued)

OTHER PUBLICATIONS

International Search Report (PCT/ISA/210) mailed on Sep. 17, 2014, by the European Patent Office as the International Searching Authority for International Application No. PCT/EP2014/060323.
(Continued)

*Primary Examiner* — Jeanette E Chapman
(74) *Attorney, Agent, or Firm* — Buchanan Ingersoll & Rooney PC

(57) ABSTRACT

An offshore drilling rig including a drill floor deck having one or more holes, each defining a well center; one or more masts upwardly extending relative to the drill floor deck, and one or more hoisting systems, each supported by at least one of the one or more masts and configured for hoisting and lowering tubular equipment through at least one of the one or more well centers; a storage area for accommodating marine riser joints in upright orientation side by side in respective upright storage positions; a riser handling apparatus, different from the hoisting systems, adapted to move at least one of said marine riser joints along a movement
(Continued)

path between its upright storage position and a prostrate maintenance/transfer position on a maintenance/transfer area, which movement path does not intersect any of the well centers.

16 Claims, 19 Drawing Sheets

(58) Field of Classification Search
USPC ..... 414/22.51–22.61
See application file for complete search history.

(56) References Cited

U.S. PATENT DOCUMENTS

| | | | | |
|---|---|---|---|---|
| 4,129,221 | A | 12/1978 | Moller | |
| 4,176,722 | A * | 12/1979 | Wetmore | E21B 19/09 166/355 |
| 4,692,081 | A | 9/1987 | Bennett et al. | |
| 5,046,896 | A * | 9/1991 | Cole | B63B 22/021 166/344 |
| 6,250,395 | B1 | 6/2001 | Torres | |
| 6,321,675 | B1 * | 11/2001 | Dybdahl | B63B 35/4413 114/264 |
| 6,524,049 | B1 | 2/2003 | Minnes | |
| 7,918,636 | B1 * | 4/2011 | Orgeron | E21B 19/087 414/22.55 |
| 8,052,369 | B2 | 11/2011 | Often et al. | |
| 8,291,845 | B2 * | 10/2012 | Wijning | B63B 35/4413 114/72 |
| 8,371,790 | B2 | 2/2013 | Sigmar et al. | |
| 2003/0159853 | A1 | 8/2003 | Archibald et al. | |
| 2003/0170095 | A1 * | 9/2003 | Slettedal | E21B 19/155 414/22.59 |
| 2004/0266290 | A1 * | 12/2004 | Gibson | E21B 17/012 441/133 |
| 2005/0019100 | A1 * | 1/2005 | Simpson | F16L 1/19 405/166 |
| 2005/0103526 | A1 | 5/2005 | Ayling | |
| 2006/0104747 | A1 | 5/2006 | Zahn et al. | |
| 2008/0136203 | A1 | 6/2008 | Krijnen et al. | |
| 2009/0220306 | A1 * | 9/2009 | Roodenburg | F16L 1/19 405/195.1 |
| 2010/0307401 | A1 * | 12/2010 | Bereznitski | B63B 39/02 114/122 |
| 2011/0048310 | A1 * | 3/2011 | Roodenburg | B63B 35/4413 114/268 |
| 2012/0067642 | A1 | 3/2012 | Magnuson | |
| 2012/0103623 | A1 | 5/2012 | Wijning et al. | |
| 2014/0190386 | A1 | 7/2014 | Wijning et al. | |

FOREIGN PATENT DOCUMENTS

| | | | |
|---|---|---|---|
| EP | 0 273 474 | A1 | 7/1988 |
| EP | 1 038 088 | A1 | 9/2000 |
| GB | 1255662 | A | 12/1971 |
| GB | 1255663 | A | 12/1971 |
| GB | 2150962 | A | 7/1985 |
| WO | 85/03050 | A1 | 7/1985 |
| WO | WO 98/56652 | A1 | 12/1998 |
| WO | WO 99/29999 | A1 | 6/1999 |
| WO | WO 99/31346 | A1 | 6/1999 |
| WO | 00/49266 | A1 | 8/2000 |
| WO | WO 2009/102196 | A2 | 8/2009 |
| WO | WO 2010/126357 | A1 | 11/2010 |

OTHER PUBLICATIONS

Friede and Goldman Ltd. "Riser Handling" http://www.fng.com/riser-handling Search. (4 pages).

* cited by examiner

RISER HANDLING ON A DRILLING RIG AND A FLIP AND SERVICE MACHINE FOR RISER HANDLING ON A DRILLING RIG

TECHNICAL FIELD

The invention generally relates to offshore drilling rigs, often also referred to as offshore drilling platforms. More particularly, the invention relates to an apparatus and a method for the handling of marine riser joints on a floatable drilling vessel such as a semi-submersible drilling rig or drill ship.

BACKGROUND

Floatable offshore drilling rigs are widely used in the exploration and exploitation of hydrocarbon reservoirs under the sea floor, in particular at relatively high water depths.

One type of floatable drilling rig is the semi-submersible drilling rig that typically obtains its buoyancy from ballasted, watertight pontoons located below the ocean surface and wave action. The operating deck can be located high above the sea level due to the high stability of the design, and therefore the operating deck is kept well away from the waves. Structural columns connect the pontoons and operating deck. Another type of floatable drilling vessels is a drill ship.

Offshore drilling rigs and, in particular, floatable offshore drilling rigs utilise a variety of tubular equipment, such as drill pipes. Marine risers are a particular type of tubular equipment used in subsea drilling operations. The marine riser (in the present disclosure also simply referred to as the riser) is made up of marine riser joints. Most marine riser joints are large elongated structures, typically defining a main tube and a number of secondary tubes as well as a number of Buoyancy elements. During the drilling operation the marine riser joints are typically assembled to a string of marine riser joints forming the riser and lowered towards the sea floor so as to create a string of marine riser joints extending from the drilling rig to the sea floor. The drill string is then advanced through the central tube of the marine riser. Marine risers joints are very large and heavy tubular elements; typical risers joints are 50-75 ft and even 90 ft long and weigh many tons. Consequently they are difficult to handle, for example when loading or offloading them to/from the drilling rig, e.g. from/to a supply ship.

U.S. Pat. No. 4,129,221 discusses riser handling on a drill ship where the riser joints are stored in horizontal orientation and hoisted to the well centre by a crane.

However, on many drilling rigs it is preferred to store the riser joints in vertical orientation, as a vertical storage requires less deck space on the operational deck. U.S. Pat. No. 8,052,369, discloses an offshore drilling rig where tubulars are stored in a shaft in vertical position. The tubulars are lifted out of the shaft and across the main deck of the drilling rig towards a catwalk machine, where they are brought into horizontal position and axially fed through a V-door in the derrick to the well centre.

It is generally desirable to provide a drilling rig and corresponding riser handling apparatus allowing efficient, loading and offloading of riser joints onto/from the drill rig (e.g. for maintenance of the riser joints) and/or for efficient maintenance of riser joints.

SUMMARY

Disclosed herein are embodiments of an offshore drilling rig.

According to one aspect, disclosed herein is an offshore drilling rig comprising:

- a drill floor deck having one or more holes, each defining a well centre;
- one or more masts upwardly extending relative to the drill floor deck, and one or more hoisting systems, each supported by at least one of the one or more masts and configured for hoisting and lowering tubular equipment through at least one of the one or more well centres;
- a storage area for accommodating marine riser joints in upright orientation side by side in respective upright storage positions;
- a riser handling apparatus, different from the hoisting systems, adapted to move at least one of said marine riser joints along a movement path between its upright storage position and a prostrate maintenance/transfer position on a maintenance/transfer area, which movement path does not intersect any of the well centres; and wherein the prostrate maintenance/transfer position defines an axial direction that does not intersect with any of the one or more well centers.

Embodiments of the drilling rig disclosed herein allow riser joints that are stored in an upright position to be placed in a prostrate position, e.g. on the main deck of the drilling rig, without interfering with ongoing drilling operations at any of the well centers.

Once placed at the maintenance/transfer position, maintenance operations may be performed on the riser joint in a safe and efficient manner. Alternatively or additionally, the riser joint may by be picked up from the maintenance/transfer position by a crane and lifted, in prostrate orientation, off the drilling rig, e.g. onto a supply vessel. Similarly, riser joints may be loaded from a supply vessel onto the maintenance/transfer position and then moved to the upright storage position.

The term "well centre" refers to a hole in the drill floor deck through which the drilling rig is configured to lower tubular equipment towards the seabed, into the body of water on which the drilling rig floats and, in particular, through which tubular equipment may be lowered all the way to the seabed. A well centre is sometimes also referred to as a drilling centre. It will be appreciated that the drill floor deck may comprise additional holes such as foxholes and mouseholes that may e.g. be used for building stands of tubulars but through which the drilling rig cannot lower tubular equipment to the seabed and/or through which the drilling rig cannot perform drilling into the seabed e.g. by lacking a system arranged to rotate a drill string with sufficient force such as a top-drive or a turntable. In some embodiments, such an additional hole is a hole in the drill floor deck through which the drilling rig cannot progress a drill string through a riser system. In some embodiments, a well centre is differentiated from an additional hole by having a diverter and/or a diverter housing arranged below so that drill string passed through the well centre extends through said diverter or diverter housing. As the movement path does not intersect with any of the well centre or well centres, the or each well centre is displaced from the movement path. In particular the well centre may be displaced by at least 1 m, such as at least 2 m, such as at least 3 m from the movement path, i.e. such that the well centre is displaced from a riser joint positioned at any position along the movement path. Similarly, the well centre may be displaced from the axis defined by the prostrate maintenance/transfer position of the riser joint.

The offshore drilling rig may be a semi-submersible drilling rig, i.e. it may comprise one or more buoyancy pontoons located below the ocean surface and wave action, and an operation platform elevated above the ocean surface and supported by one or more column structures extending from the buoyancy pontoon to the operation platform. Alternatively, the offshore rig may be of a different type, such as a jack-up drilling rig or a drill ship.

For the purpose of the present description, the term "mast" refers to a support structure upwardly extending relative to the drill floor deck and supporting a hoisting system for hoisting and lowering tubular equipment (such as drill strings, casings and/or risers) towards the seabed so that drilling into the seabed can be performed. The mast may extend from the drill floor deck or from a deck different from the drill floor deck. The hoisting system may be a hydraulic hoisting system comprising upwardly extending cylinders for carrying the load to be hoisted or lowered typically via large sheaves mounted on top of the cylinders. In some embodiments, the hoisting system may be a draw works system. The mast of a drilling rig is sometimes formed as a derrick, a tower or other suitable support structure.

The term tubular equipment is intended to refer to tubular equipment that is advanced through the well centre towards the sea floor during one or more stages of the drilling operation. In particular, the term tubular equipment refers to straight tubular elements that can be joined to form a string of tubular equipment. The tubular equipment may be selected from drill pipes and/or other tubular elements of the drill string, risers, liners and casings. Examples of tubular elements of the drill string include drill pipes, drill collars, etc. For the purpose of the present descriptions these will also generally be referred to as tubulars. Tubulars such as riser joints define a longitudinal direction along their longitudinal axis and a lateral direction normal to the longitudinal axis.

For the purpose of this description, the term drill floor deck is intended to refer to the deck of an operating platform of an offshore drilling rig immediately above which joints of tubulars are assembled to form the drill string which is advanced through the well centre towards the seabed. The part of the drill floor deck in immediate proximity of the well centre is normally referred to as the drill floor, which is the primary work location for the rig crew and/or machines performing similar functions, such as iron roughnecks. The drill floor normally comprises a rotary table for rotating the drill string. The drill floor deck may be arranged on the same level as or on a different level than, e.g. elevated from, a main deck of the drilling rig. The main deck may comprise storage space e.g. for storing heavy equipment such as BOPs and Christmas trees.

The storage area for riser joints may be located in a riser bay having a floor that is recessed relative to the main deck. The riser bay me be sized such that less than 80%, e.g. less than 60%, e.g. less than 50%, e.g. less than 30% of the length of a riser joint stored upright in the riser bay extends above the main deck level or the level on which the maintenance/transfer position is located. Hence, the riser bay may be between 3 m and 30 m deep, e.g. more than 5 m, e.g. more than 10 m, e.g. more than 15 m, e.g. more than 20 m deep. A recessed storage position results in the centre of mass of the drill rig to be lowered.

Embodiments of the drilling rig disclosed herein allow loading/offloading of the riser joints without using the main hoisting system. Moreover, maintenance and/or other manipulations of the riser joints (including those that require removal of the Buoyancy elements that surround the riser joint) may be performed on board of the drilling rig, and without interfering with the drilling operation. The riser handling apparatus may be embodied as a single machine/device or as multiple machines/devices, e.g. a first riser handling machine and a second riser handling machine. The first riser handling machine may be operable to move a riser joint in upright orientation e.g. between a tilt position and a storage position of the riser; in particular, the first riser handling machine may be operable to move an upright riser joint laterally, i.e. substantially horizontally, across the floor of the storage area. It will be appreciated that the first riser handling machine may be operable to lift an upright riser joint relative to the floor of the storage area, e.g. sufficiently high so as to lift the riser joint out of or into an attachment mechanism or guiding mechanism, e.g. less than 5 m, e.g. less than 3 m e.g. less than 2 m. However, the first riser handling machine does not need to lift the riser entirely out of the recessed riser bay. The second riser handling machine may be operable, alone or in cooperation with the first riser handling machine, to tilt the riser joint between an upright and a prostrate orientation and, optionally, to elevate the riser joint from the tilt position to the maintenance/transfer position. In particular, the tilt position may be on the same level as the storage area or slightly elevated or recessed relative to the storage area, e.g. by less than 3 m, e.g. less than 2 m, e.g. less than 1 m. The first riser handling machine may be a crane, e.g. a gantry crane. The second riser handling machine may be an elevator device or a tilt mechanism comprising a pivotable support member.

For the purpose of the present description the term "upright" is intended to refer to a vertical or close to vertical orientation where a riser joint stands on one of its ends while the other end is pointing upward, e.g. an orientation defining a small angle compared to the vertical direction e.g. less than 45°, such as less than 30°, e.g. less than 20°, e.g. less than 10°, e.g. less than 5°. Similarly, the term "prostrate" is intended to refer to a horizontal or close to horizontal orientation where a riser joint lies flat on the deck or a similar support, e.g. defining a small angle compared to the horizontal direction e.g. less than 45°, such as less than 30°, e.g. less than 20°, e.g. less than 10°, e.g. less than 5°.

In some embodiments, the drilling rig is a dual (or even multiple) activity rig where more than one main drilling operations and/or parallel operations may be performed through two or even more separate well centres. To this end, in some embodiments, the offshore drilling rig comprises two (or even more) well centres displaced from each other, and corresponding masts (or a common mast structure) and hoisting systems configured for hoisting and lowering tubular equipment through the respective well centres.

The present disclosure relates to different aspects including the drilling rig described above and in the following, corresponding methods, apparatus, and/or products. Each aspect may yield one or more of the benefits and advantages described in connection with the other aspects, and each may have one or more embodiments corresponding to the embodiments described in connection with one of the other aspects and/or disclosed in the appended claims.

In particular, according to one aspect, disclosed herein is an offshore drilling rig comprising:

- a drill floor deck having one or more holes, each defining a well centre;
- one or more masts upwardly extending relative to the drill floor deck, and one or more hoisting systems, each supported by at least one of the one or more masts and configured for hoisting and lowering tubular equipment through at least one of the one or more well centres;

one or more tubular feeding apparatus operable to feed tubular equipment from a storage position to at least one of the one or more hoisting systems;

a storage area for accommodating marine riser joints in upright orientation side by side in respective upright storage positions;

a riser handling apparatus, different from the hoisting systems, adapted to move at least one of said marine riser joints along a movement path between its upright storage position and a prostrate maintenance/transfer position on a maintenance/transfer area, which movement path does not intersect any of the well centres; and wherein the riser handling apparatus comprises at least one riser handling device different from the one or more tubular feeding apparatus.

The tubular feeding apparatus may comprise horizontal and/or vertical pipe handling equipment. The horizontal pipe handling equipment may be any suitable apparatus or device for moving tubulars in a horizontal orientation, e.g. in the axial direction of the tubular. Examples of horizontal pipe handling equipment include catwalk machines, such as catwalk shuttles. The vertical pipe handling equipment may be any suitable apparatus or device for moving tubulars in a vertical orientation. Examples of vertical pipe handling equipment include column rackers, hydrarackers, and other types of rackers, hydraulic arms, gantry cranes, etc. or combinations thereof. In some embodiments, the drilling rig comprises pipe feeding equipment configured to advance drill pipes from a pipe storage location towards the well centre. The pipe storage may be located on one side of the well centre. The riser storage area may be located on a different side, e.g. opposite the pipe storage location. Accordingly a riser feeding equipment may be arranged to feed riser joints from the riser storage area to the well centre, e.g. using an inclined chute when the riser storage area is recessed relative to the drill floor and/or main deck and laterally positioned in close proximity e.g. immediately next to the mast.

When the riser handling apparatus comprises more than one machine or component, one or some of these components may also be operable to feed riser joints from the riser storage area to the hoisting system. For example, the riser handling machine may comprise a gantry crane or similar device for laterally moving riser joints in upright orientation between a storage position and different transport positions; one transport position may be a tilt position as described herein while another, different, transport position may be a chute for feeding riser joints upward to the well centre.

When all elements of the riser handling apparatus are different from any tubular feeding mechanism that is operable to feed tubular equipment other than riser joints to the well centre, a loading/offloading and/or maintenance of riser joints is facilitated even during ongoing drilling operations involving tubular equipment other than risers. Even when a part of the riser handling equipment is also used for feeding riser joints to the well centre, interference with drilling operations may be kept at a minimum.

In some embodiments, the riser storage area is arranged in immediate vicinity of the mast and recessed relative to the drill floor, thus allowing feeding of risers via a chute, e.g. an inclined chute towards the well centre where the hoisting system can pick up the riser joint. Consequently, moving a riser joint from the storage position to the well centre does not involve tilting the riser joint into a prostrate position. Consequently, the second riser handling equipment operable to tilt the riser joint is not needed for feeding the riser joints to the well centre, and tilting of riser joints to the maintenance/transfer position may be performed without significantly interfering with the running of risers or other drilling operations.

According to one aspect, disclosed herein is an offshore drilling rig comprising:

a drill floor deck having one or more holes, each defining a well centre;

one or more masts upwardly extending relative to the drill floor deck, and one or more hoisting systems, each supported by at least one of the one or more masts and configured for hoisting and lowering tubular equipment through at least one of the one or more well centres;

one or more cranes, such as a mast crane, pedestal crane, or knuckleboom crane, operable to move tubular equipment across at least a portion of a main deck of the offshore drilling rig and/or operable to lift tubular equipment such as riser joints off the drilling rig;

a storage area for accommodating marine riser joints in upright orientation side by side in respective upright storage positions;

a riser handling apparatus, different from the hoisting systems and different from said cranes, adapted to move at least one of said marine riser joints along a movement path between its upright storage position and a prostrate maintenance/transfer position on a maintenance/transfer area, which movement path does not intersect any of the well centres.

Hence, the movement of riser joints between their storage position and a maintenance/transfer position does not require large deck cranes such as knuckleboom cranes. Hence, these may be used for other operations parallel to the riser movement between storage and maintenance/transfer positions, e.g. for lifting riser joints between the maintenance/transfer position and a supply vessel. Moreover movement of riser joints may be performed in a safe and efficient manner.

According to one aspect, disclosed herein is an offshore drilling rig comprising:

a drill floor deck having one or more holes, each defining a well centre;

one or more masts upwardly extending relative to the drill floor deck, and one or more hoisting systems, each supported by at least one of the one or more masts and configured for hoisting and lowering tubular equipment through at least one of the one or more well centres;

a storage area for accommodating marine riser joints in upright orientation side by side in respective upright storage positions; wherein at least one end of each of the marine riser joints, when stored in upright orientation at their respective storage positions, is located at a level below said maintenance/transfer position;

a riser handling apparatus, different from the hoisting systems, adapted to move at least one of said marine riser joints along a movement path between its upright storage position and a prostrate maintenance/transfer position on a maintenance/transfer area, which movement path does not intersect any of the well centres; wherein the riser handling apparatus is operable to move a marine riser joint in upright orientation from its storage position to a tilting position; wherein, at the tilting position, at least one end of the marine riser joint is located at a level below an upper end of the riser joint when the riser joint is in its storage position; and wherein the riser handling apparatus is operable to tilt the marine riser joint from the upright orientation at the tilting position to a prostrate orientation.

Hence, the movement of riser joints between the storage and the maintenance/transfer position does not require cranes that have a lift capacity and height sufficient for lifting a riser joint in vertical orientation above and across the main deck. Moreover, the movement of riser joints is performed efficiently and safely. In some embodiments, the riser handling apparatus is operable to laterally move a marine riser joint in upright orientation from its storage position to a tilting position, i.e. the movement is along the lateral direction of the riser joint, normal to its longitudinal direction.

In some embodiments, when the marine riser joint is positioned at the tilting position, at least one end of the marine riser joint is located at a level below said maintenance/transfer position. Moreover, in some embodiments, during movement from the storage to the tilt position, at least one end of the marine riser joint is located at a level below an upper end of the riser joint when the riser joint is in its storage position and/or below said maintenance/transfer position.

From time to time, marine riser joints have to undergo maintenance operations, such as scheduled maintenance operations or maintenance occasioned by detected damages, malfunction, and wear and tear of the riser joint. Such maintenance operations may take several days and involve disassembly of parts of the riser joint such as removal of Buoyancy elements, and or operations such as sandblasting, paint removal, painting. To this end, marine riser joints are typically brought onshore to an onshore maintenance facility for maintenance. However, with an increasing desire to increase the length of riser joints, transporting riser joints becomes more and more difficult. In particular, the transport of the riser joints between a harbour and a maintenance facility by truck becomes increasingly difficult. It would thus be desirable to increase the efficiency of the maintenance of riser joints.

According to one aspect, disclosed herein is an offshore drilling rig comprising:

- a drill floor deck having one or more holes, each defining a well centre;
- one or more masts upwardly extending relative to the drill floor deck, and one or more hoisting systems, each supported by at least one of the one or more masts and configured for hoisting and lowering tubular equipment through at least one of the one or more well centres;
- a storage area for accommodating marine riser joints;
- a maintenance/transfer area comprising a riser maintenance station;
- a riser handling apparatus, adapted to move at least one of said marine riser joints between the storage area and the maintenance station.

Hence, by providing a maintenance station for riser joints on an offshore drilling rig, the need for transporting riser joints from the drilling rig to an onshore maintenance facility is reduced or even eliminated.

In some embodiments, the riser maintenance station comprises one or more riser manipulation devices, each operable to perform at least one or more of the following operations on a respective marine riser joint while the marine riser joint is located at a prostrate maintenance position at the riser maintenance station:

- move the riser joint longitudinally and/or laterally
- elevate one or both ends of the marine riser joint
- rotate the riser joint around its longitudinal axis.

In some embodiments, the riser maintenance station comprises a device operable to remove one or more Buoyancy elements from the marine riser joint while the marine riser joint is located at the maintenance station. Moreover, the maintenance station may comprise one or more riser maintenance machines operable to perform one or more maintenance operations on a riser joint, such as sandblasting equipment, riser inspection equipment insertable into the riser joint, and/or the like.

Consequently, efficient handling of the riser during maintenance is facilitated so as to allow personnel and/or equipment to access the riser from all sides. In some embodiments, the maintenance station comprises a protective enclosure shaped and sized to accommodate one or more riser joints in prostrate position separated from each other so as to allow service personnel to access each of the one or more riser joints from both lateral sides of the riser joint. Hence, the riser joint and maintenance crew is protected against humidity and bad weather during maintenance, and the surroundings of the maintenance station are protected from being negatively affected from e.g. sandblasting or other operations. The enclosure may be a housing completely enclosing the riser or it may be a structure that encloses the circumference of the riser joint but that has one or two open ends, or ends covered by doors or the like. The enclosure may have one or more closable access openings to allow riser joints to be moved into and out of the enclosure. For example the access openings may be in the form of doors or hatches and/or a portion of the roof or wall that may be slidable or that can otherwise be opened. In some embodiments the enclosure may be collapsed, folded, or otherwise reduced in shape when not in use. For example, the enclosure may comprise a number of separately slidable sections that may be slid into one another when not in use so as to free up deck space for other uses.

The riser maintenance station may be located on the main deck or another suitable operational deck or even under deck inside the hull of the drilling rig. In some embodiments, the storage area comprises a riser bay recessed relatively to an operational deck, e.g. the main deck, of the drilling rig, the riser bay having a floor and side walls connecting the floor and the operational deck; wherein the maintenance station is located on a level below said operational deck, and wherein the drilling rig comprises a passage from the floor of the riser bay and the maintenance station, e.g. a passage allowing an axial movement of a riser joint from the storage area to the maintenance station. The maintenance station may be located on the same level as the floor of the riser bay or on a different level, e.g. on a level between the floor level of the storage area and the operational deck or even below the floor level of the storage area. In some embodiments, the riser maintenance station may be part of a larger structure, e.g. a building providing accommodation and/or work areas for the crew and/or a building accommodating equipment.

The riser maintenance station may be shaped and sized so as to allow a single riser joint or several riser joints, e.g. no more than 2, e.g. no more than 3, e.g. no more than 4 or even more riser joints to be placed inside the enclosure spaced apart sufficiently far from each other that maintenance personnel and machines may access each riser joint from all sides. In particular, there may be a distance of at least 1 m, e.g. at least 1.5 m between adjacent riser joints and/or between a riser joint and a side wall of the enclosure. In some embodiments the riser joints may be located in separate enclosures or separated parts of a single enclosure. When the enclosure is adapted to accommodate several riser joints, the maintenance station may comprise multiple riser manipulation devices so as to allow concurrent work on multiple riser joints.

It will be appreciated that a riser maintenance station as described herein may be used on drilling rigs where riser joints are stored in upright orientation as well as on rigs with prostrate riser joint storage.

Further disclosed herein are embodiments of riser tilt equipment for tilting the riser joints from their upright storage position in the riser bay into a prostrate position for maintenance, either on the floor of the riser bay or on the main deck or other deck elevated from a riser bay floor.

In particular, according to one aspect, disclosed herein is a riser handling apparatus for moving a marine riser joint between an upright orientation and a prostrate orientation, the apparatus comprising an elongated support member for receiving and supporting at least a part of the length of the marine riser joint, the support member being arranged pivotally around a pivot axis, and a drive mechanism configured to pivot the support member and a marine riser joint supported by the support member between an upright orientation where the riser positioned on a first surface and a prostrate orientation where the riser is positioned on a second surface elevated relative to the first surface.

The pivot axis may be fixed relative to the elongated support; alternatively the elongated support may be operable to move axially during the pivoting. The support member may support the entire length of the riser joint or a major part of it such as at least 50%, e.g. at least 75%, e.g. at least 85%.

The first surface may be at or near a floor of a riser bay such as slightly elevated or recessed from the floor of the riser bay as described above. Similarly, the second surface may be at or near the main deck level, e.g. as described above. In some embodiments, the second level may be elevated above the main deck or it may be at a level between the first level and the main deck. For example, the maintenance/transfer bay may generally be provided at a level above the level of the lower ends of the riser joints stored in upright position in the storage area, e.g. a level between the lower and the upper ends of the riser joints stored in upright position in the storage area. The maintenance/transfer bay may even be provided at a level above, e.g. directly above, the level of the upper ends of the riser joints stored in upright position in the storage area so as to facilitate lifting the riser joint off the maintenance/transfer position by a crane. The support member may comprise one or more attachment devices, such as a clamp, a grapper, and/or a protrusion extending into a central tube of the riser joint, for securing the riser joint during the pivot operation.

According to yet another aspect, disclosed herein is a riser handling apparatus for moving a marine riser joint between an upright storage position on a storage surface and a prostrate maintenance/transfer surface elevated from the storage surface, the apparatus comprising:

- a first hoisting device comprising an attachment device configured for attachment to a first end of a marine riser joint stored in its upright storage position, where a second end of the riser joint is positioned proximal to the storage surface; the first hoisting device being operable to move a marine riser joint in upright orientation from its storage position to a tilting position;
- a second hoisting device located at the tilting position and comprising attachment device for receiving a second end of a marine riser joint suspended at its first end from said first hoisting device; wherein the second hoisting device is operable to elevate the second end of the marine riser joint to the maintenance/transfer surface while and/or after the first end of the marine riser joint is moved to the maintenance/transfer surface.

The attachment device for attachment to a first end of a marine riser joint may be a gripper or clamp of a crane, e.g. a gantry crane. The attachment device for receiving a second end of a marine riser joint may be a gripper or clamp similar to the attachment device for attachment to a first end of a marine riser joint, just oriented in the opposite direction, or another suitable device for securing the second end to the hoisting device. The hoisting device may comprise a hydraulic device, a drawworks or other suitable device for lifting the second end of the marine riser joint.

BRIEF DESCRIPTION OF THE DRAWINGS

FIG. 1 shows a semi-submersible drilling rig 100 and how the riser joints 105 are loaded from a supply vessel 107 onto the rig, horizontally placed on the maintenance/transfer bay 106 at an edge of a riser bay 104, and then tilted into upright position by the riser handling apparatus 108, and stored in upright position in the riser bay 104. The riser joints may be moved between the vessel 107 and the maintenance/transfer bay 106 by a crane (not shown in FIG. 1) such as a knuckleboom crane, of the drilling rig.

Figure 1:
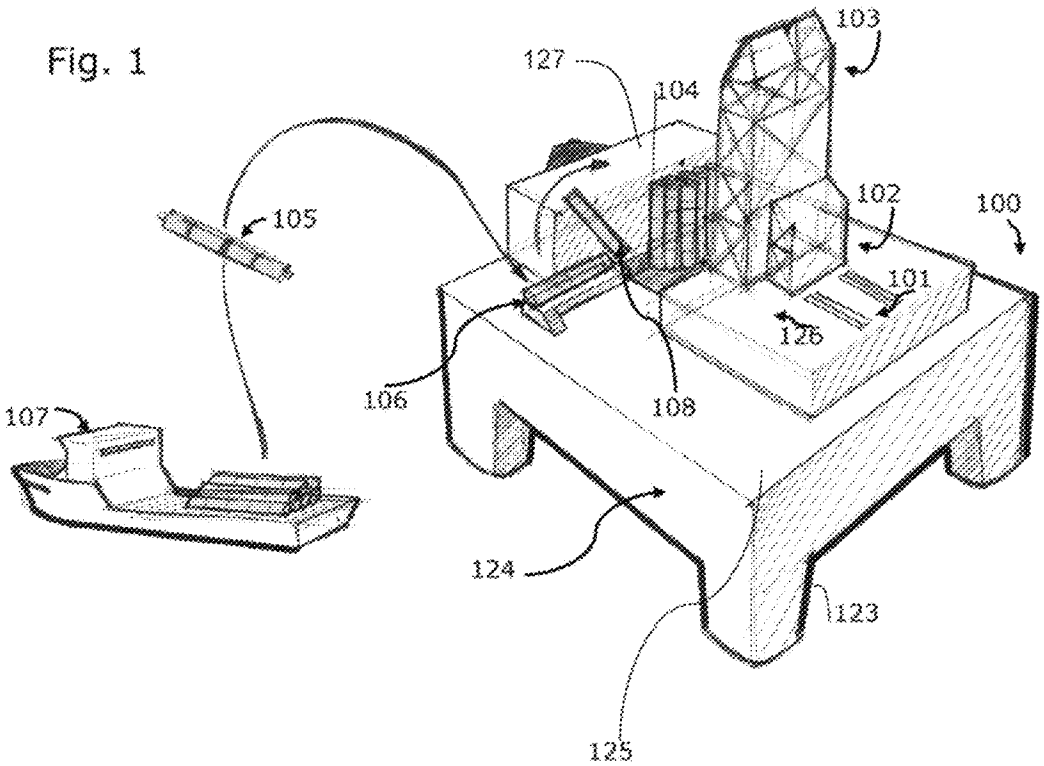
FIG. 1 shows a semi-submersible drilling rig.

In this example the drilling rig 100 is a semisubmersible drilling rig but other rig types using vertical storage of riser joints are also feasible. The rig 100 comprises pontoons (not shown) from which support columns 123 extend upwardly, and a topside platform 124 supported by the columns 123. During operation, the drilling rig floats at the ocean surface with the pontoons under the water and the support columns extending out of the water such that the topside platform is elevated above the water. To this end, the pontoons may be filled with ballast water so as to cause the rig to be submersed to the desired level.

The topside platform comprises a main deck 125 and a drill floor deck 126 arranged elevated from the main deck. In other embodiments, the drill floor deck may be on the same level as the main deck.

FIG. 1 further shows the mast 103 including the main hoisting system for raising/lowering tubular equipment through the well centre, a pipe setback area 102 for drill pipes and catwalk machines 101 for advancing drill pipes to the mast 103. As can be seen, the loading/offloading of the riser joints from/to a supply vessel 107 does not involve the mast 103 or the catwalk machines 101, i.e. does not interfere with the drilling operation because the machines handling drill pipe and/or casing are not substantially affected. The drilling rig of FIG. 1 further comprises an accommodation structure 127 for the drill crew and other personnel. The accommodation structure is positioned right next to the riser bay 104, i.e. the riser bay 104 is sandwiched between the mast 103 and the accommodation structure 127. It will be appreciated that, the deck layout may be different from the example of FIG. 1. However, it is generally desirable to provide an efficient utilisation of the limited space on a drilling rig and often the riser storage area is positioned in close proximity to other structures. It is therefore desirable to facilitate riser handling that does not require unnecessary space and that interferes only little, if at all, with other operations, in particular the drilling operation. While other positions of the riser storage are possible as well, when the riser storage area is located directly next to the mast as in the example of FIG. 1, riser joints may be fed efficiently to the well centre, e.g. using a chute. When tubulars other than riser joints, such as drill pipes, are stored on another side of the mast 103, e.g. a side opposite from the riser joints as in FIG. 1, a particularly efficient handling of tubulars is provided and concurrent handling of drill pipes and riser joints is further facilitated.

Figure 2:
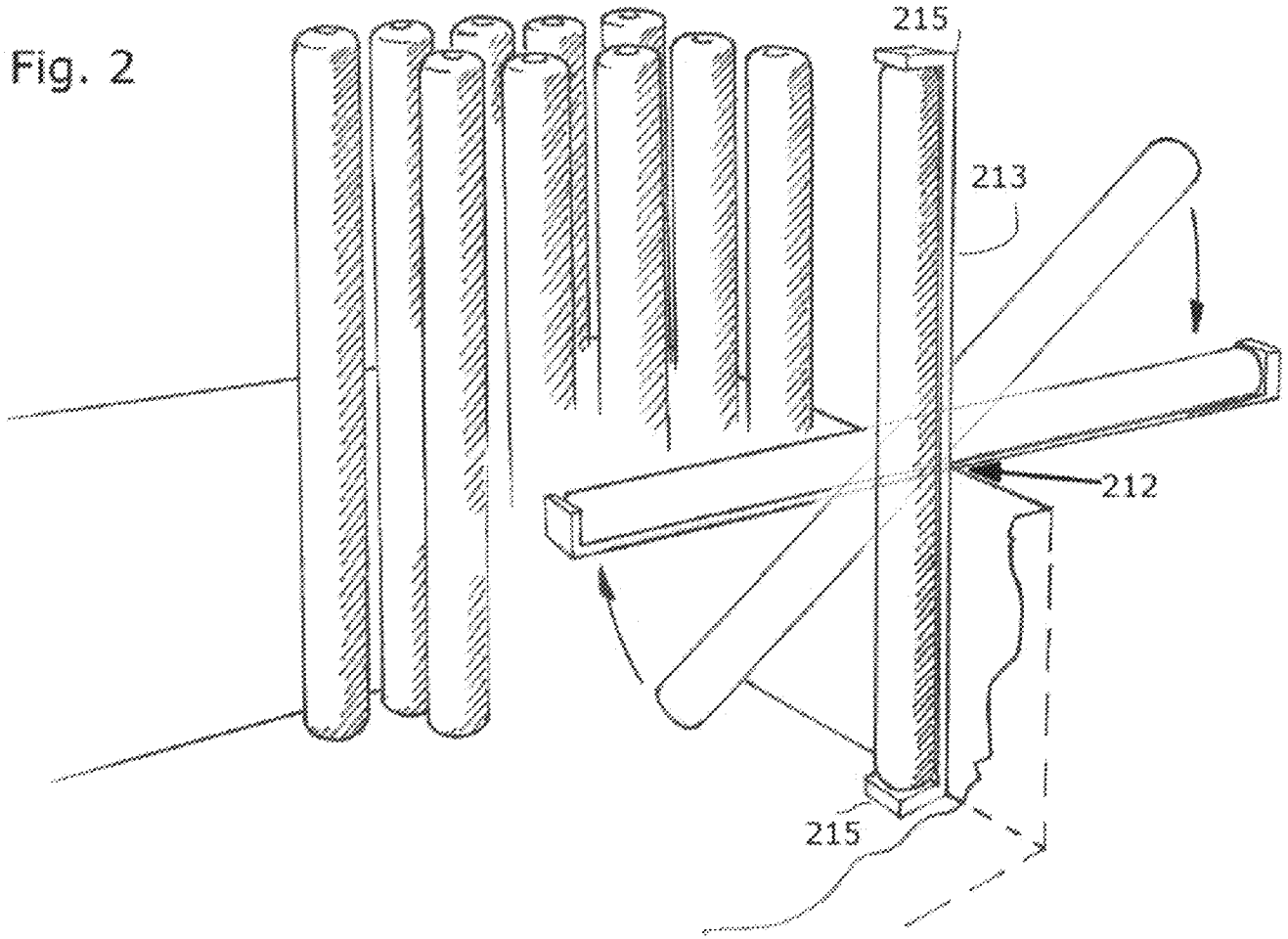
FIG. 2 shows an example of a riser tilting apparatus where the riser joint is pivoted around a pivot axis.

FIG. 2 shows an example of a riser tilting apparatus where a riser joint is pivoted around a pivot axis 212 and placed on the main deck while supported by a pivotable, elongated support member 213. The elongated support member 213 has mounting elements 215 at its respective ends that laterally extend from the support element. The mounting elements may be operable to elevate the riser joint in its vertical position and/or to rotate the riser joint around its axis.

Figure 3:
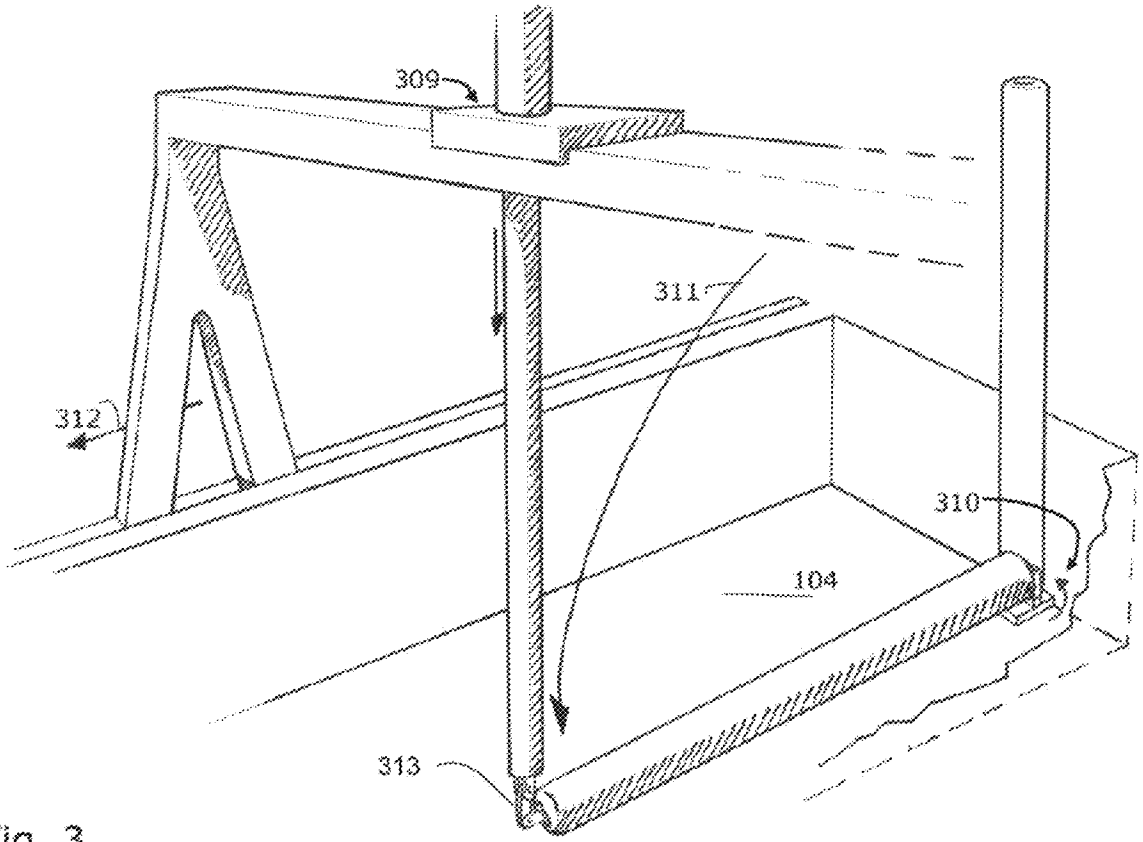
FIG. 3 shows an example of a riser tilting apparatus where the riser joint is put on the floor of a riser bay.
Figure 4A:
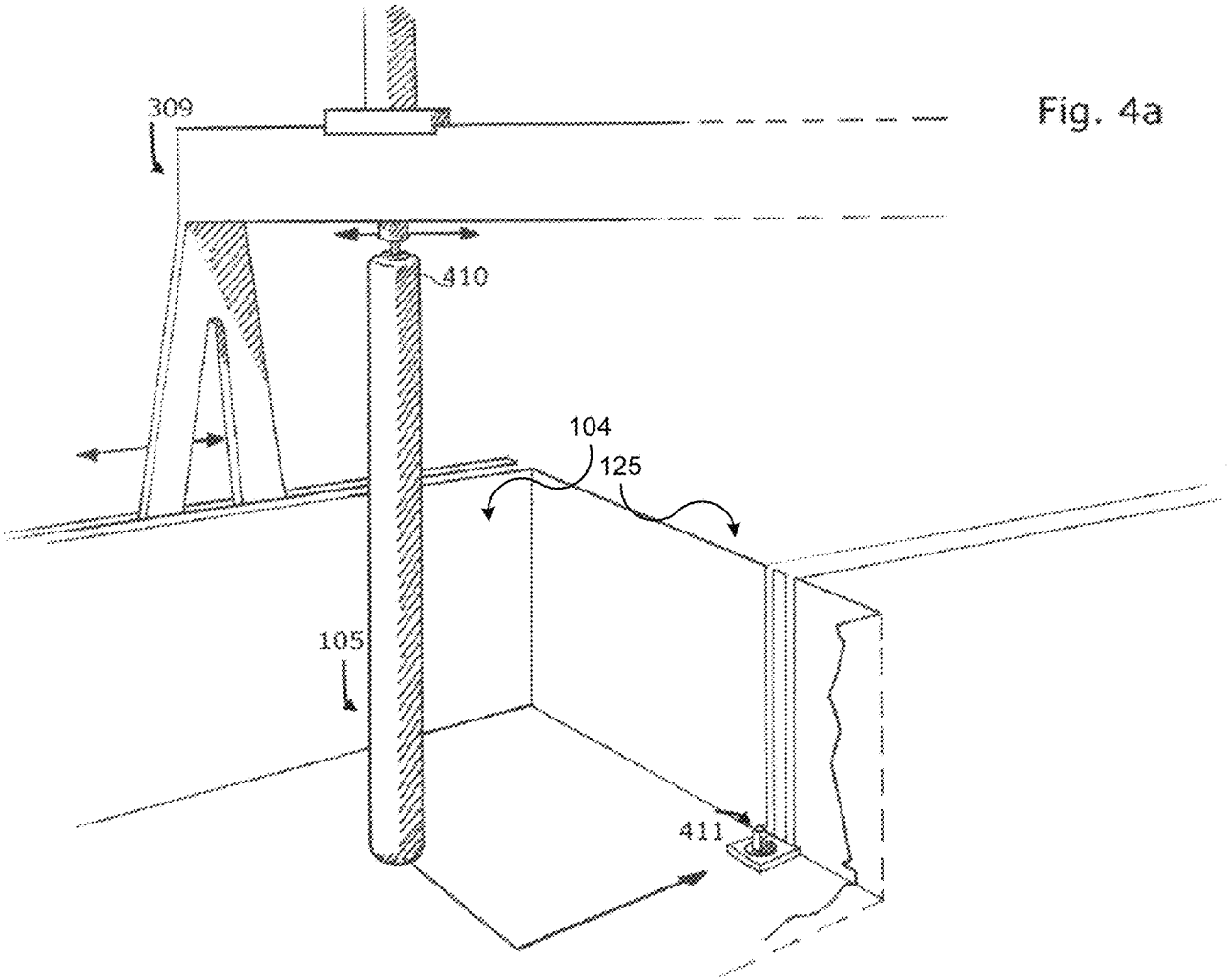
FIGS. 4*a-f* show an example of a riser tilting apparatus.
Figure 4B:
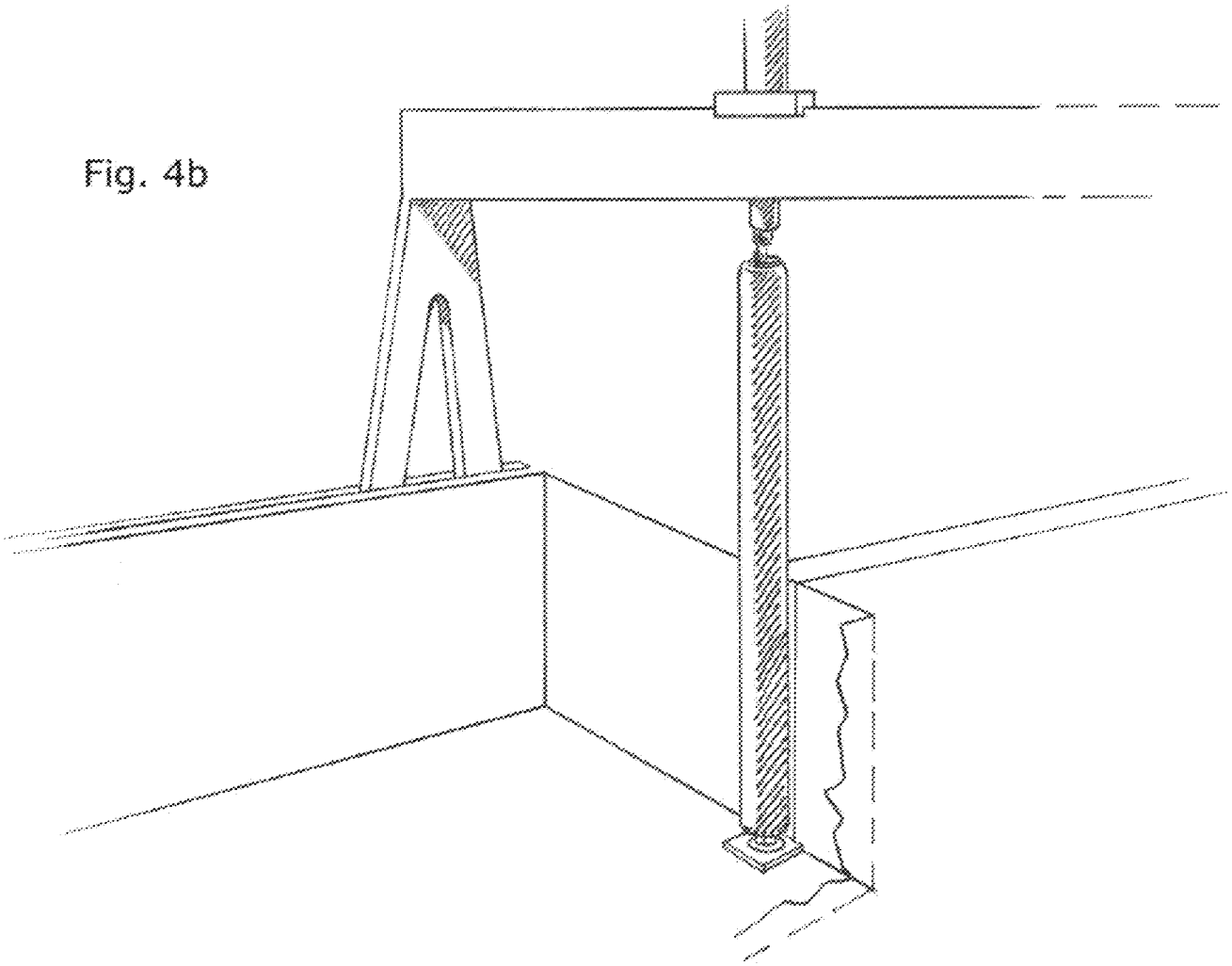
Figure 4C:
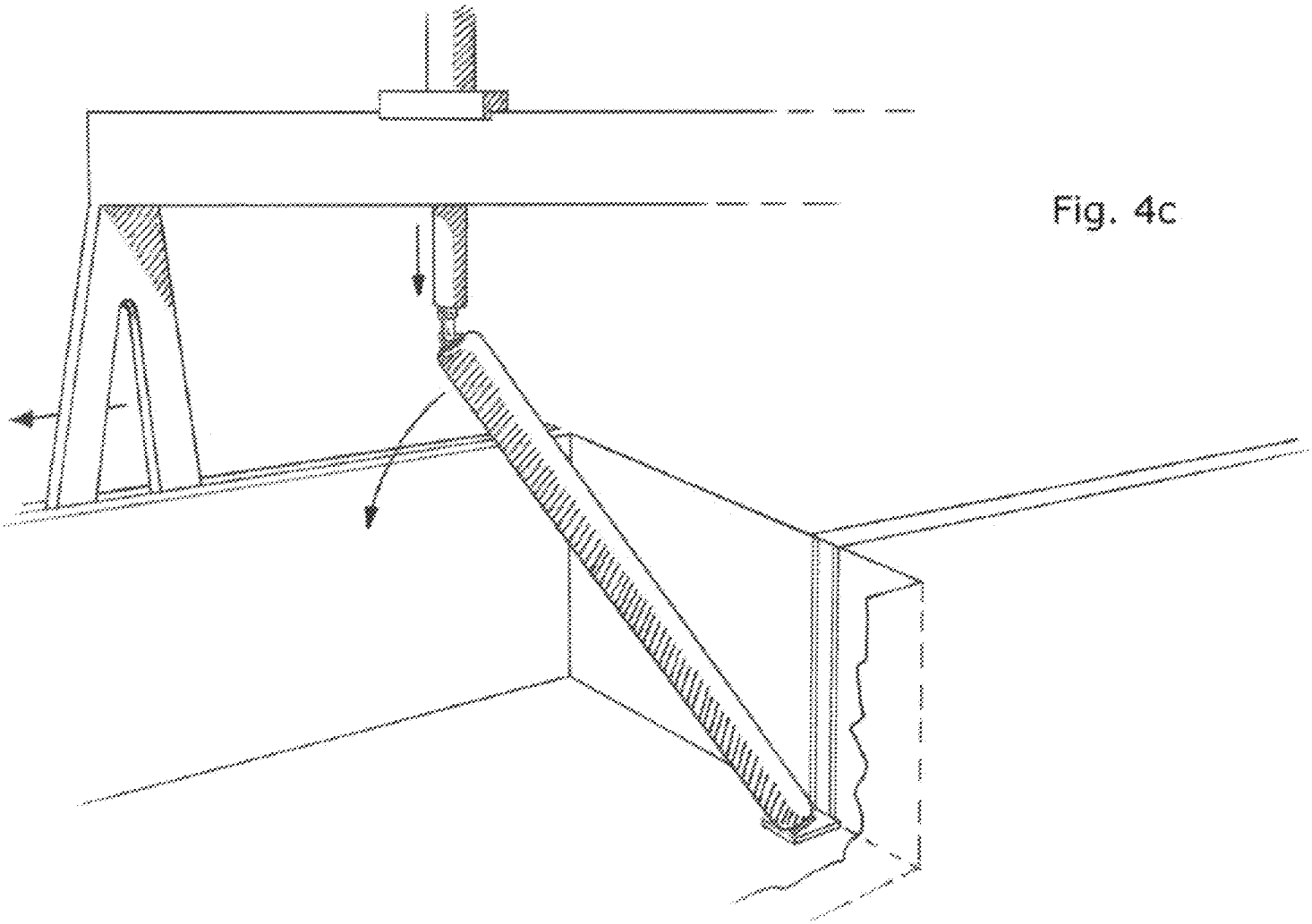
Figure 4D:
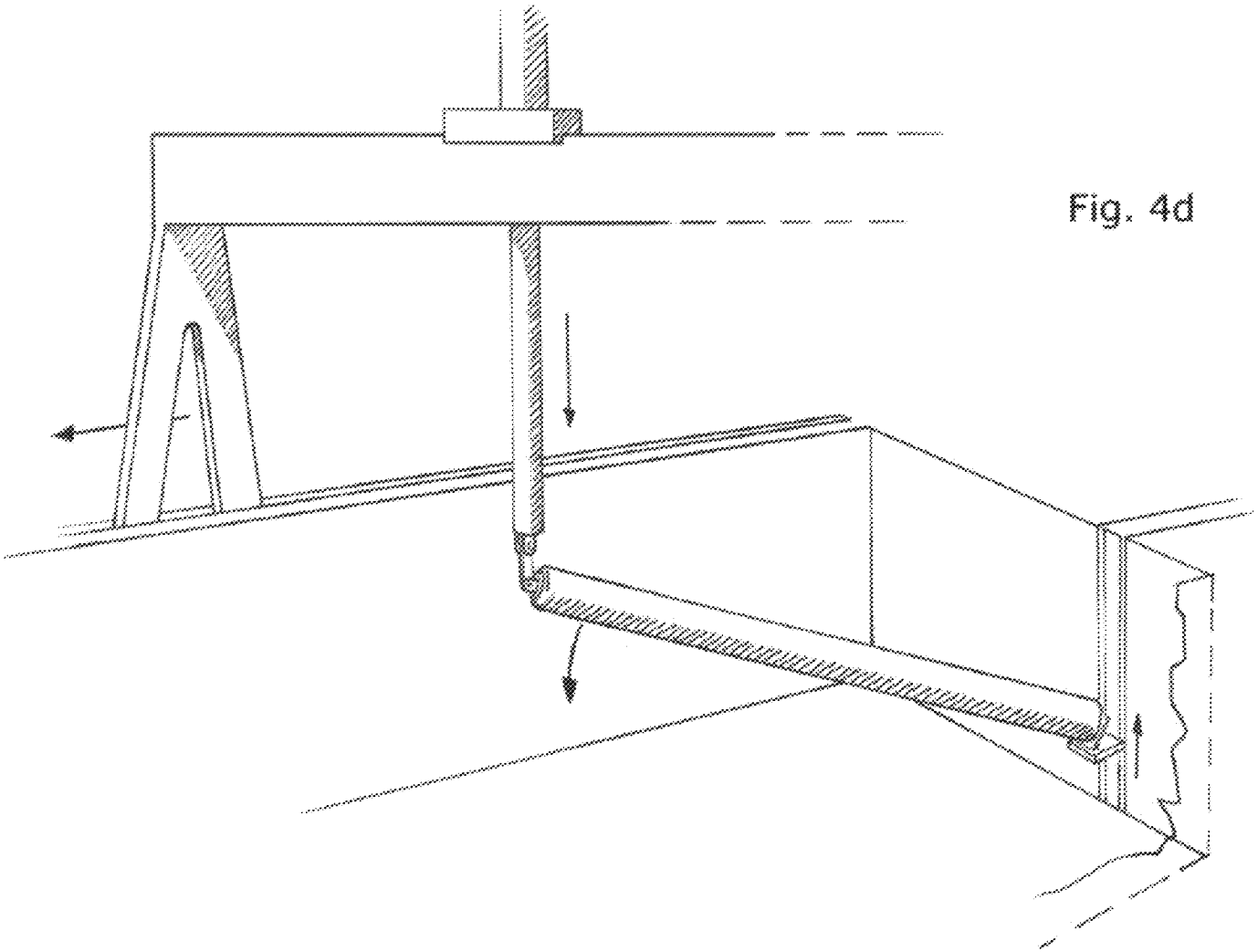
Figure 4E:
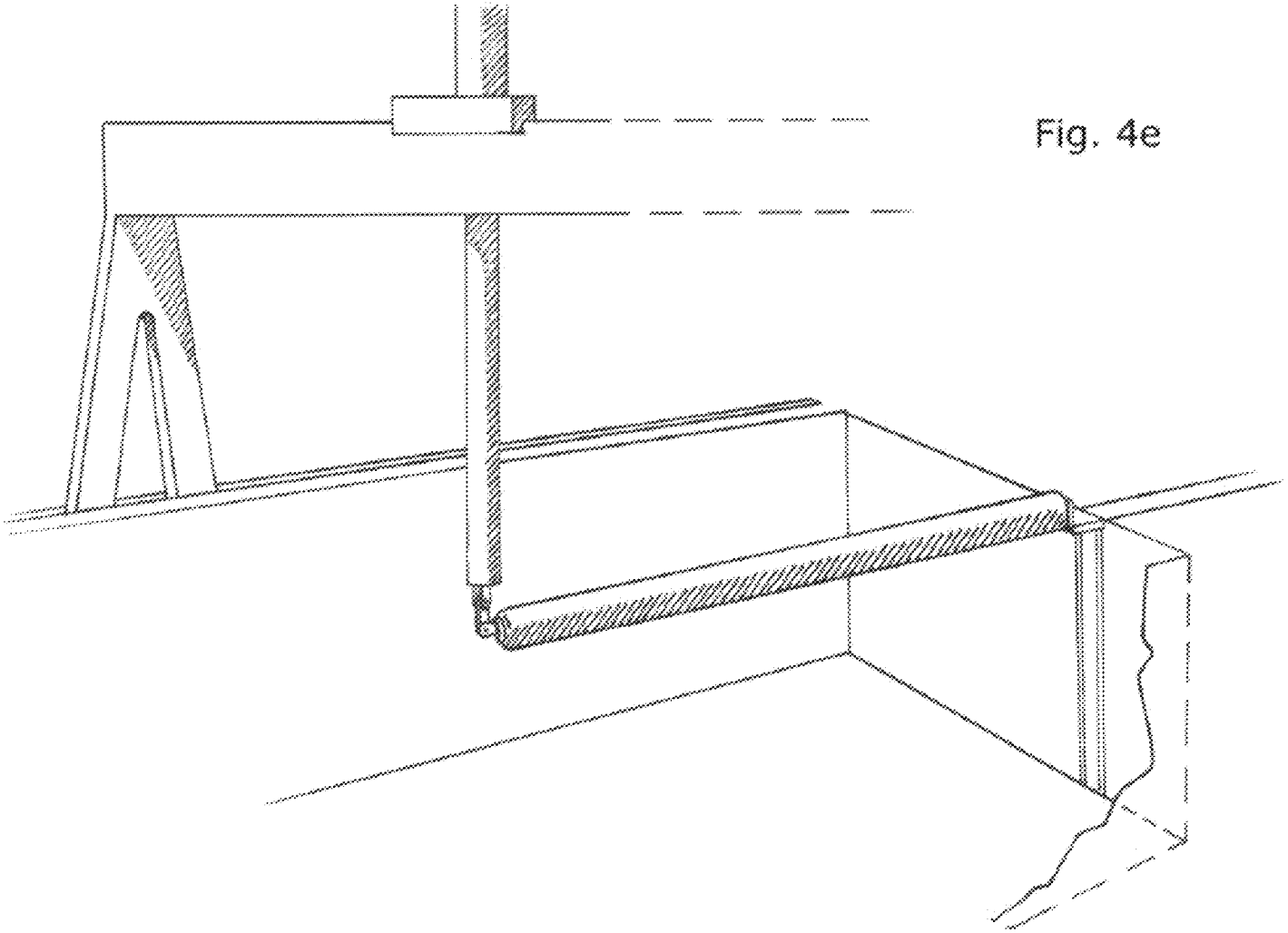
Figure 4F:
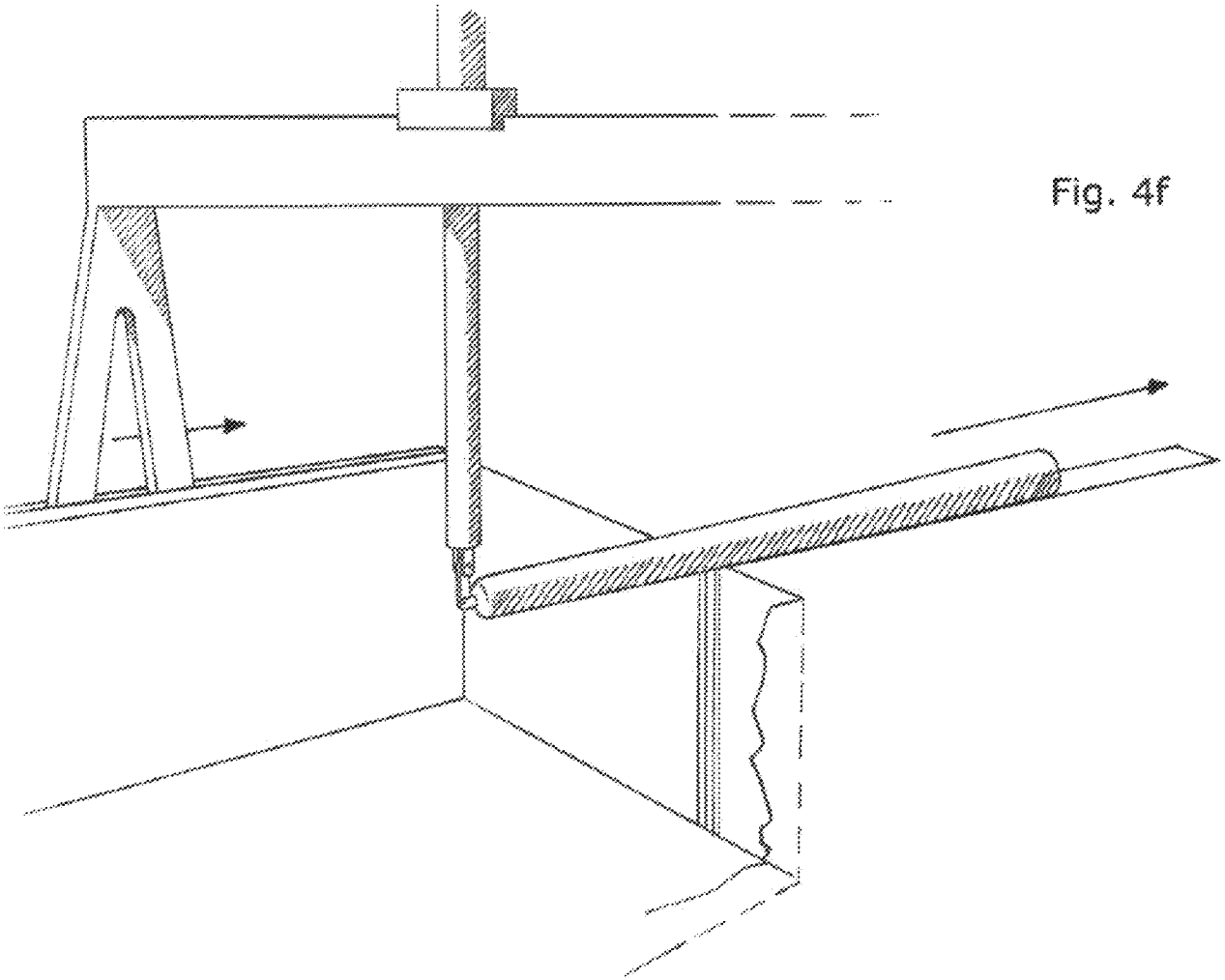

FIG. 3 shows an example of a riser tilting apparatus where the riser joint is lowered onto the floor of the riser bay 104, typically using a gantry crane 309 that traverses the riser bay. During the tilt operation, the upper end of the riser joint may be suspended from and supported by the gantry crane 309. To this end, the gantry crane comprises a grapping tool 313 or another suitable attachment tool for attachment to an end of the riser joint allowing the riser joint to be lifted and moved. The riser joint is moved to the tilting apparatus and the lower end of the riser joint is attached to a pivoting mount 310 positioned at or near the floor of the riser bay, e.g. at or near a side wall of the riser bay. During this movement, the riser joint only needs to be elevated from the floor of the riser bay sufficiently high so as to allow free movement of the riser joint in its upright orientation across the floor of the riser bay. After being fastened to the pivoting mount 310, the gantry crane 309 guides the riser joint downwards in a tilting motion as indicated by arrows 311 and 312, such that the riser joint ends up resting on the floor of the riser bay 104. To this end, the grapping tool 313 may comprise a pivotable element, e.g. as illustrated in FIG. 3. In some embodiments, once the riser joint is positioned in the floor of the riser bay, it may be axially moved e.g. through an opening in one of the side walls of the riser bay and into a maintenance station.

In some embodiments, having the riser joint fixed at both ends provides for a controlled flipping motion. It is typical for drilling vessels having vertical riser storage that a gantry crane is used to pick up riser joints from the storage position and to transport them in upright orientation towards the drill floor/well centre. In some embodiments the same gantry crane is used to perform the function of the gantry crane 309. However, compared to a conventional gantry crane for handling risers, the gantry crane 309 has an extended reach to allow the riser grapping tool 313 to be extended further towards the bottom of the riser bay. In some embodiments the grapping tool can be operated in a vertical range of more than 1 meter, such as more than 5 meters, such as more than 10 meters, such as more than 15 meters, such as more than 20 meters, such as more than 25 meters. In some embodiment the gantry crane 309 is arrange so that the riser grapping tool allows tilting of a grapped riser joint by about 90 degrees. In some embodiments a separate grapping tool is mounted for moving risers towards the drill floor with little or no allowance for tilting of the riser and the flipping operation with a larger allowance for tilting such as at least up to 90 degrees. In some embodiments an overhead crane, such as a knuckle-boom crane, performs the function of the gantry crane 309.

FIG. 4 shows another example of a riser tilting apparatus. During the tilt operation, the upper end 410 of the riser joint 105 may be fastened to and be suspended from a gantry crane 309 that transverses the riser bay 104 where it is understood that the gantry crane 309 may share one or more of the features discussed in relation to the gantry crane of FIG. 3. The lower end of the riser joint is supported and lifted by an elevator 411. Hence, as illustrated in FIG. 4*a*, the riser joint is first moved in upright orientation from its storage position onto a riser elevator 411 that may slide one end of a riser 105 between a position at the floor of the riser bay 104 and up to or above the main deck level 125 or another operational deck of the platform. The elevator is lifted, while the gantry crane 309 lowers the upper end of the riser joint so as to tilt the riser joint into horizontal position, as illustrated in FIGS. 4*b*-4*e*. Finally, the riser joint is moved axially onto the maintenance/transfer position as illustrated in FIG. 4*f*. While FIGS. 4*b*-*e* illustrate a process where the elevator 411 is lifted concurrently with the lowering of the gantry crane 309, it will be appreciated that, alternatively, the gantry crane may initially lower the upper end of the riser joint while the elevator remains in its bottom position, e.g. similar to the tilting operation shown in FIG. 3. Once in a horizontal orientation, the gantry crane and the elevator may then be lifted so as to raise the riser joint while in horizontal orientation.

Figure 5:
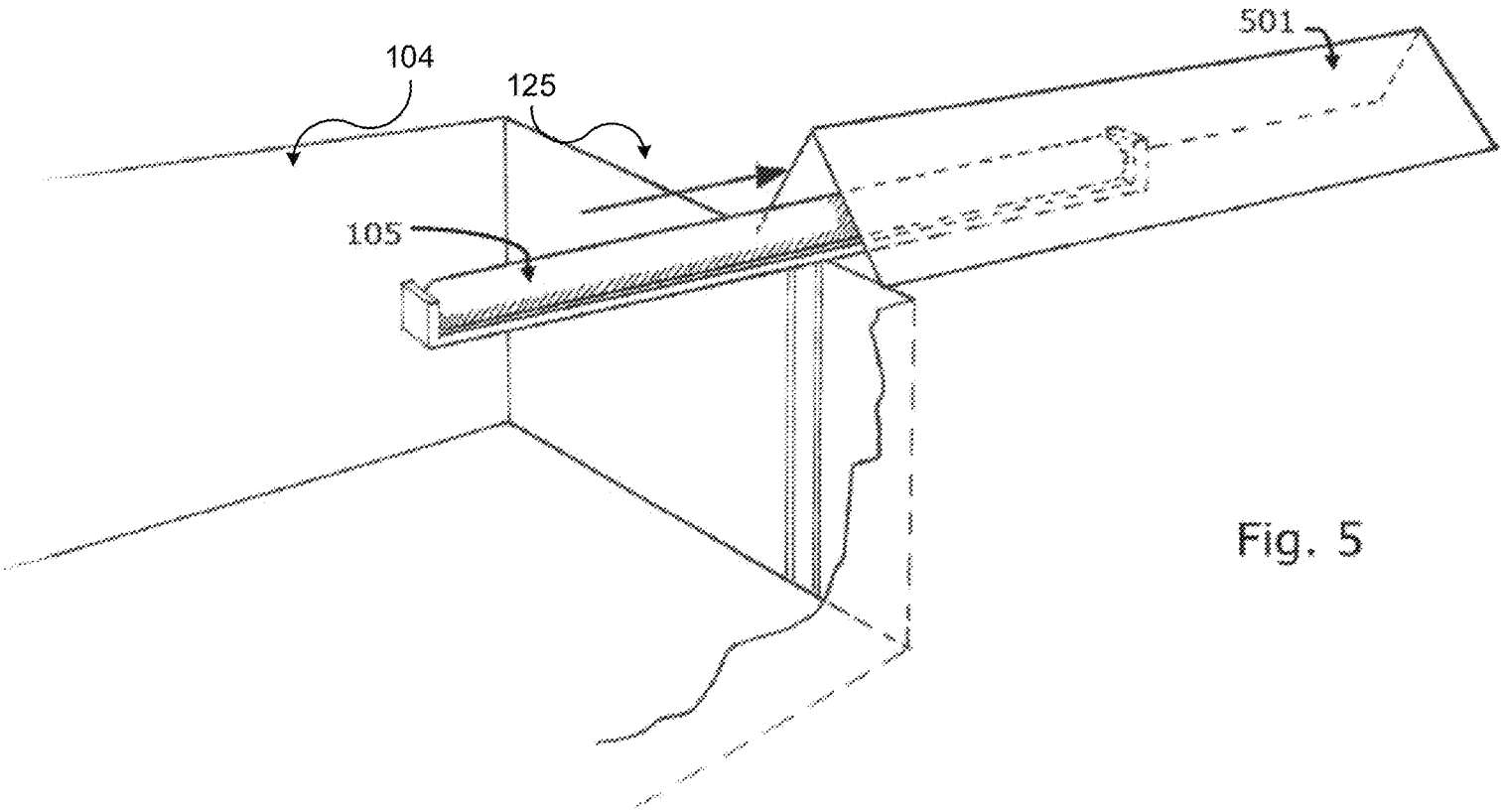
FIG. 5 illustrates an example of a riser enclosure placed on a deck of a drilling rig.

FIG. 5 illustrates an example of a riser enclosure 501 placed on a deck 125 of a drilling rig. When the riser joint 105 has been moved to a horizontal position it can be enclosed to accommodate various tasks being performed on the riser. Such an enclosure may be used to protect people working on the riser from adverse weather but may also be applied to shield operations such as sand blasting and painting. The enclosure can be located on, for example, the main deck 125. In this example the enclosure is shown in conjunction with the riser tilting apparatus of FIG. 2, but it might just as well be used with other embodiments of riser tilting apparatus, for example, but not limited to, the ones shown in FIGS. 3 and 4. The shape, size and exact location may vary accordingly, for instance the enclosure may be expandable, have a telescopic functionality and/or be removable. In some embodiments the enclosure can be opened or removed to allow a riser joint to be moved in or out in the horizontal position. In some embodiments the enclosure is elevated above the main deck 125 along with the riser joint when placed in the horizontal position e.g. to allow, for instance, a forklift to pass underneath.

Figure 6:
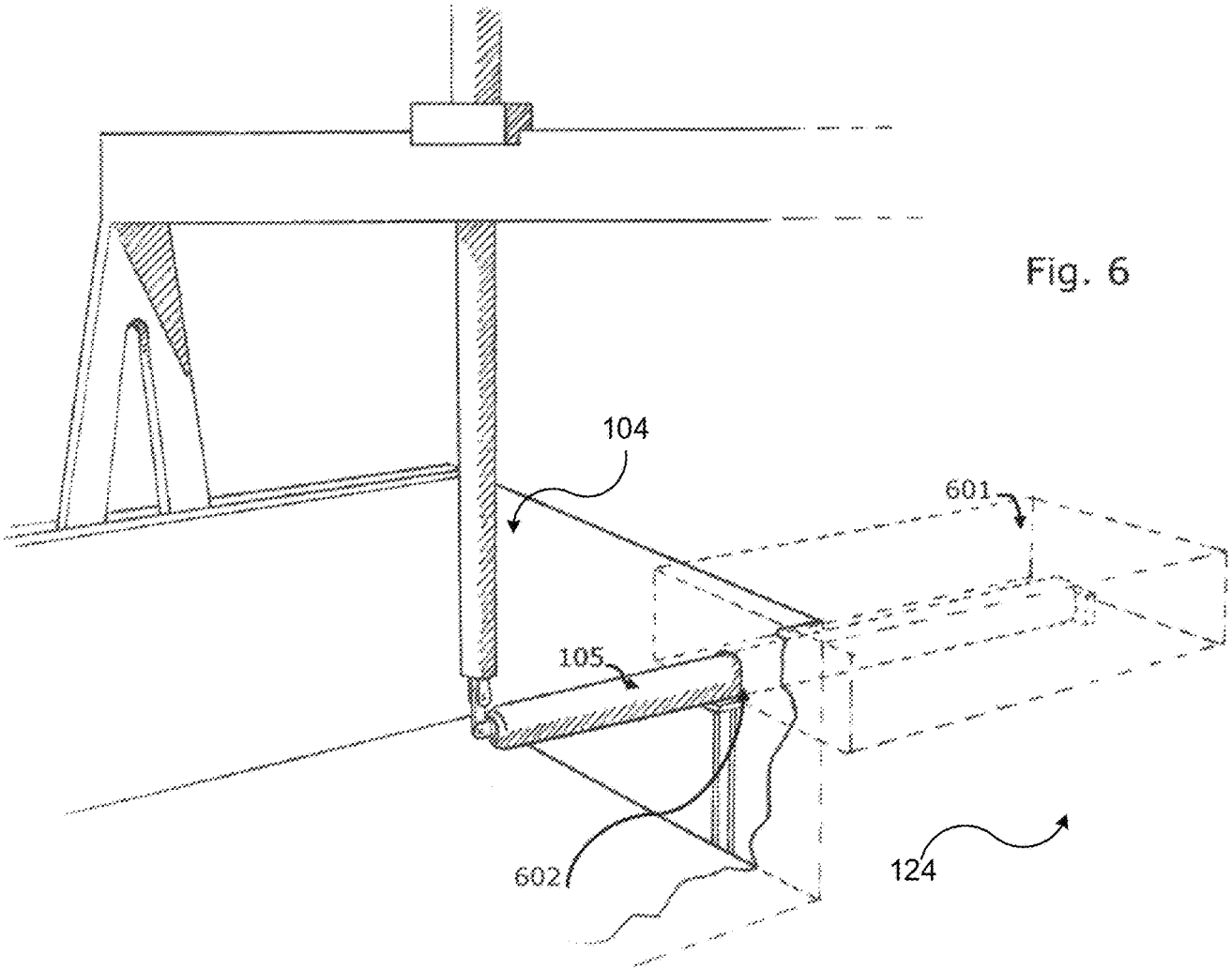
FIG. 6 illustrates an example of a riser enclosure placed inside the hull of a drilling rig.

FIG. 6 illustrates another example of storing a riser joint 105 horizontally in an enclosed space 601 with the purpose of performing various tasks on the riser joint. In this example the riser joint 105 is elevated and moved to a horizontal position. It is then moved axially into the hull of the platform 124 through a designated hatch 602 in the side wall of the riser storage bay and into a closed compartment 601 inside the platform. It should be noted that several degrees of enclosure of the riser can be achieved, i.e. by moving the riser joint further or less into the hull 124, so the riser joint is either fully or partly enclosed. In one embodiment the riser joint is placed partly in the compartment in the hull and a removable/collapsible enclosure is use to enclose the entire riser joint. It will further be appreciated that the closed compartment 601 may be provided at different levels relative to the main deck and relative to the floor of the riser bay. For example, the closed compartment may be located on the same level as the floor of the riser bay, thus allowing the riser joint to be axially moved into the compartment, once the riser joint has been lowered on the floor of the riser bay, e.g. as described in connection with FIG. 3 above, without the need for lifting the riser joint to another level. In jet another embodiment the riser joint may be lowered into an enclosed space underneath the floor of the riser bay, e.g. by an elongated elevator; or through an elongated hatch in the floor of the riser bay.

Figure 7:
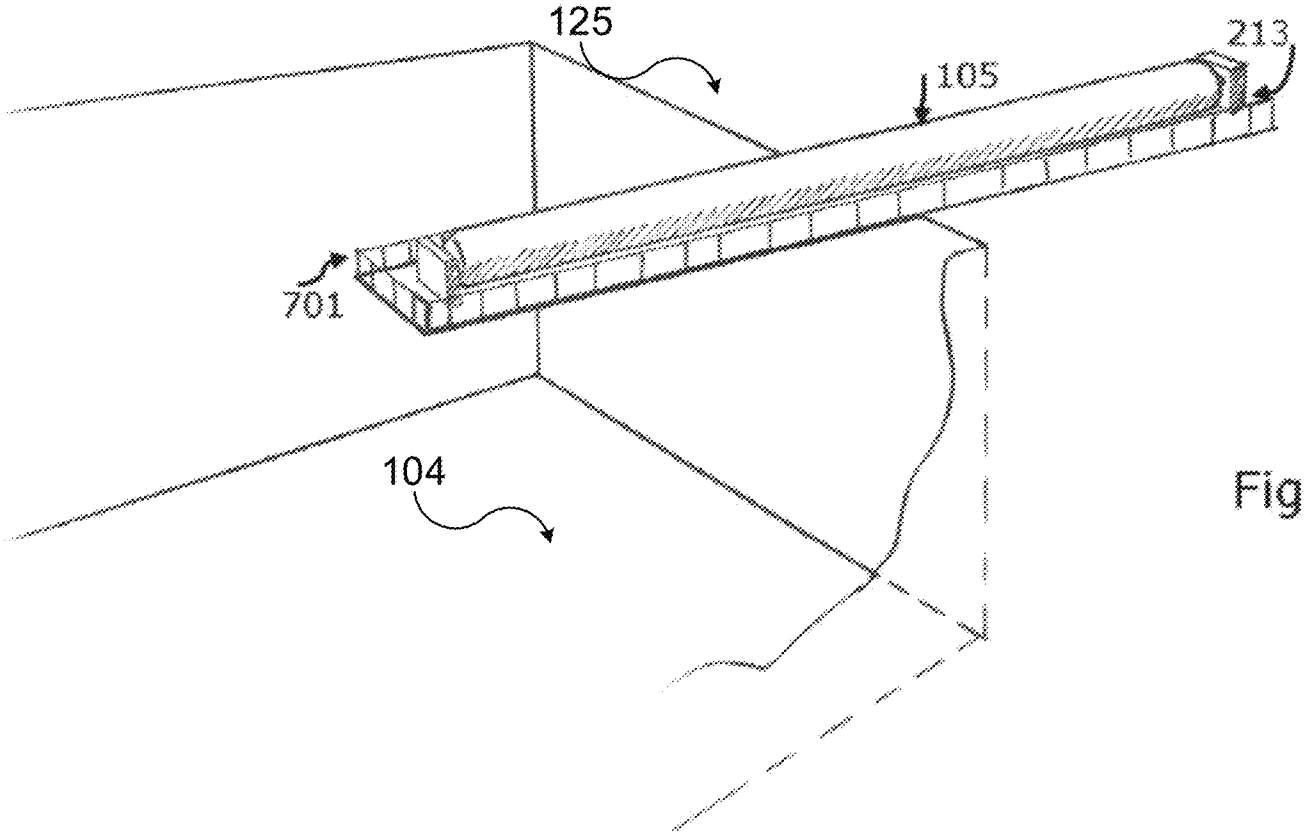
FIG. 7 illustrates an example of walkways providing access to a riser.

FIG. 7 illustrates an example of walkways providing access to a riser joint 105 placed horizontally on a drilling rig, e.g. drilling rig 100 of FIG. 1. In order to perform various tasks requiring the presence of personnel, a means of access to the whole length of the riser joint is often desirable. In this example the walkway 701 is fixed to the elongated support member 213, e.g. an elongated support member as described in FIG. 2, and located on the main deck 125. In this example the enclosure is shown in conjunction with riser tilting apparatus of FIG. 2, but might just as well be used with other embodiments of riser tilting apparatus, for example, but not limited to, the ones shown in FIGS. 3 and 4. Walkways are relevant in the case where e.g. the riser joint has a full or partial overhang, for example over the riser bay 104, or if the horizontal maintenance/transfer position of the riser is elevated from the deck.

The access ways as shown in FIG. 7 may be fixed rigidly to a support structure as shown, but other solutions may also be applied, e.g. the walkways may be moved into place by means of a skid or rail system, by being lifted in place by a crane or lifting system or it could be foldable (such as fold up along the sides of the elongated support member) to save up space in the support structure's vertical position.

Figure 8A:
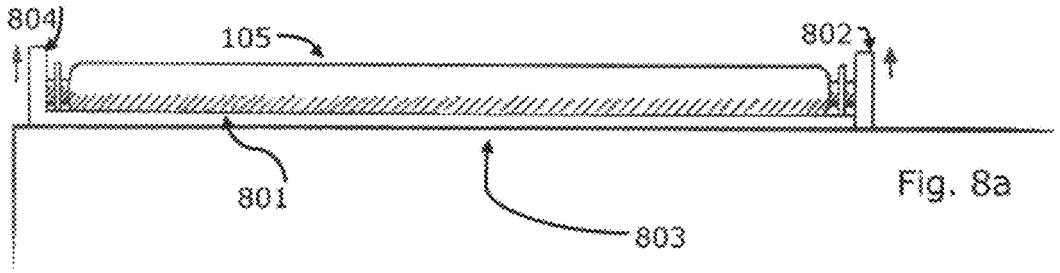
FIG. 8 (*a, b, c*) shows examples of handling a riser in a horizontal position.

FIGS. 8 *a, b, c* show examples of handling a riser joint in a horizontal position. When the riser joint is placed in a horizontal position, there are several ways of manipulating it in order to perform the desired tasks. In some embodiments the riser joint is placed in a handling apparatus 803 able to lift and/or rotate the riser joint. In some embodiments the functionality of the handling apparatus is integrated into the maintenance/transfer bay. In some embodiments the functionality of the handling apparatus is integrated into the elevator of FIG. 4 or the elongated support member which, in some embodiments, acts as the maintenance/transfer bay when the riser joint is held in the horizontal orientation/position. In FIG. 8*a* the riser joint 105 is resting on a bed 801 which is connected to mounting elements 802, 804 mounted at each end of the bed 801 and operable to support respective ends of the riser joint 105. In some embodiments one or more of the mounting elements 802, 804 are removable from the bed 801 for instance to provide a more compact arrangement when the handling apparatus is not in use. In some embodiments the mounting elements 802, 804 comprise riser grapping/stabbing tools arranged for engagement/disengagement with the riser placed on the bed 801, thus allowing the riser joint to be lifted in or out of the bed 801 in a horizontal position.

Figure 8B:
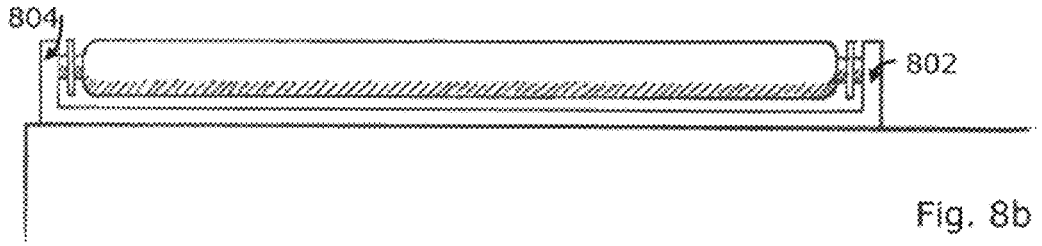

FIG. 8*b* shows the riser joint elevated by means of the mounting elements 802, 804. In this position the whole outer geometry of the riser joint is accessible for instance to allow 360 degree inspection of the riser, to allow removal and/or mounting of buoyancy elements, painting and/or sand blasting.

Figure 8C:
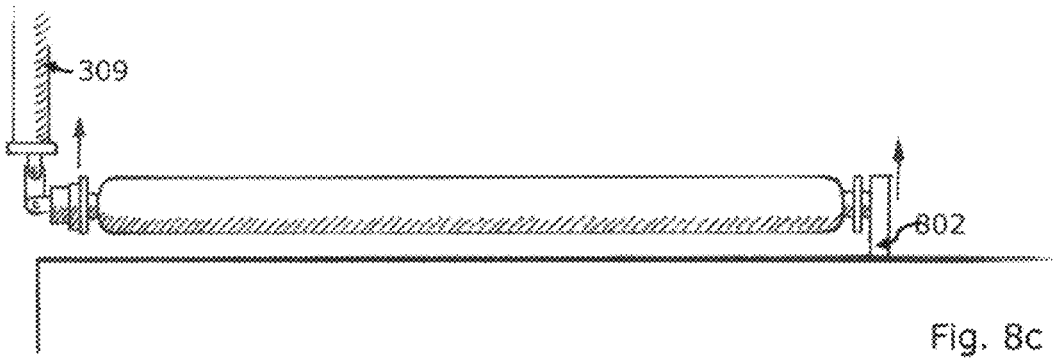

FIG. 8*c* illustrates an alternative means of achieving the above described movement options. By means of a gantry crane 309 pinning the riser at one end, and a mounting element 802 pinning it at the other, the riser can be elevated and rotated. A bed (not shown) similar to the bed 801 can also be included to allow the riser joint to be lifted in or out of the bed 801 in horizontal position. When the riser joint is placed in the horizontal position using the gantry crane 309 and without an elongated support member 213, the bed 801 may be removable to allow the riser joint to be positioned vertically in the bay as well as being lifted in or out of the bed 801 in horizontal position. It will be appreciated, though not explicitly shown in FIG. 8, that the handling apparatus may be enclosed or enclosable in an enclosure, e.g. as described in connection with FIG. 5 or 6.

Figure 9:
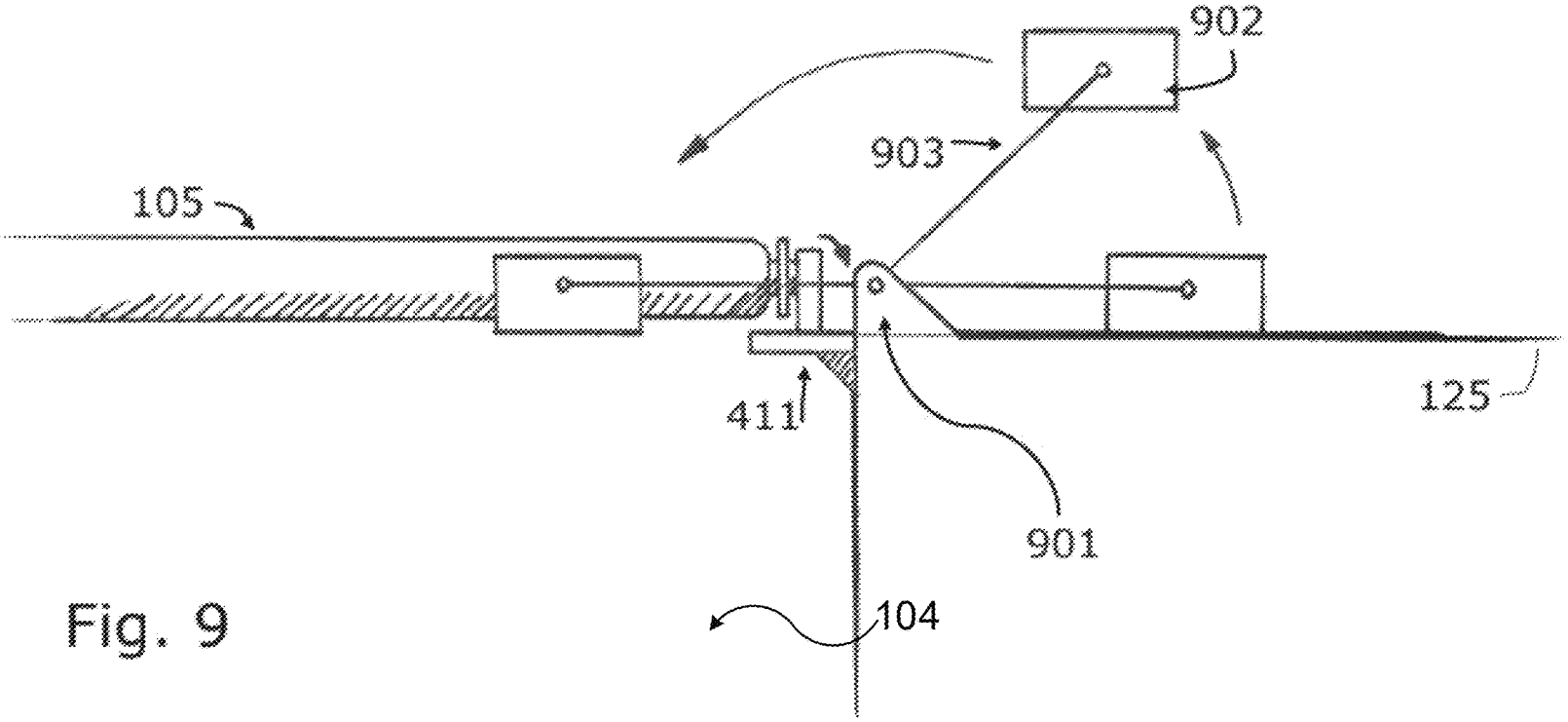
FIG. 9 shows an example of a riser support mechanism.

FIG. 9 shows an example of a riser support mechanism 901. A riser joint 105 is shown to be elevated on the way to a maintenance/transfer bay (not shown), for example in a manner similar to that shown in FIG. 4. The riser joint 105 is located at the top of the riser bay 104 and level with the maintenance/transfer bay—in this case also the main deck. In many cases the riser joint will be raised at least a little above the main deck 125 to allow for a bed to be positioned under the riser joint. To allow the riser to be shifted onto the maintenance/transfer bay, a device 901 is provided with an arm structure 903 for moving a support member 902 out over the riser bay and under the riser joint 105 so as to provide support to the riser joint. This allows the riser elevator 411 to remove its support of the riser joint and to slide out of the way to allow the riser joint, now supported by the support member 902, to be slid onto the main deck 125. Alternative embodiments performing the described support function include a sliding skid system embedded in the main deck, a dedicated support device moving parallel to the edge of the riser bay or allowing the support structure of the riser elevator 411 to skid onto the main deck 125 or maintenance/transfer bay 106, or other support devices that allow movement of a riser in prostrate orientation along the axial and/or lateral direction of the riser joint.

Figure 10:
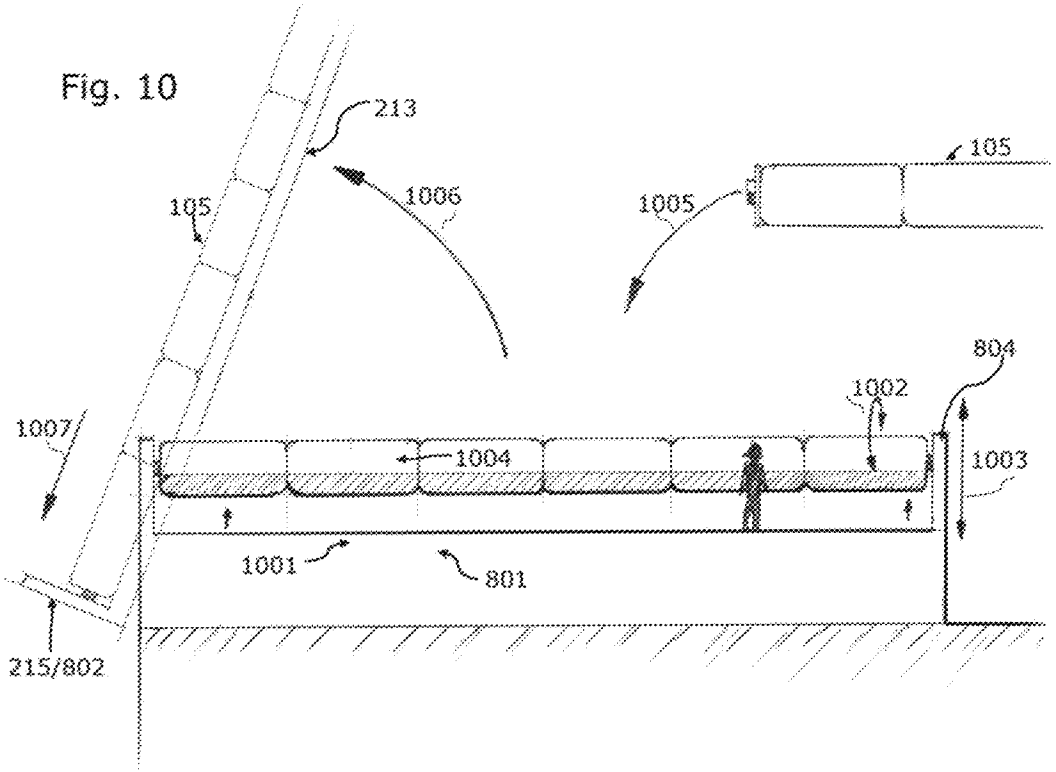
FIG. 10 illustrates a side view of an example of a riser handling apparatus.

FIG. 10 illustrates an embodiment of a riser handling apparatus 1001 similar to the apparatus of FIG. 2 and operable as a maintenance/transfer bay where the riser joint 105 can be elevated and rotated for maintenance as indicated by arrow 1002 and arrow 1003, allowing for removal of buoyancy elements 1004. FIG. 10 further illustrates how a riser joint may be lifted (arrow 1005) onto the apparatus by a crane (e.g. when offloading the riser joint from a supply ship), and how the riser joint can be tilted into upright position for storage in the riser bay (arrows 1006 and 1007).

Figure 11:
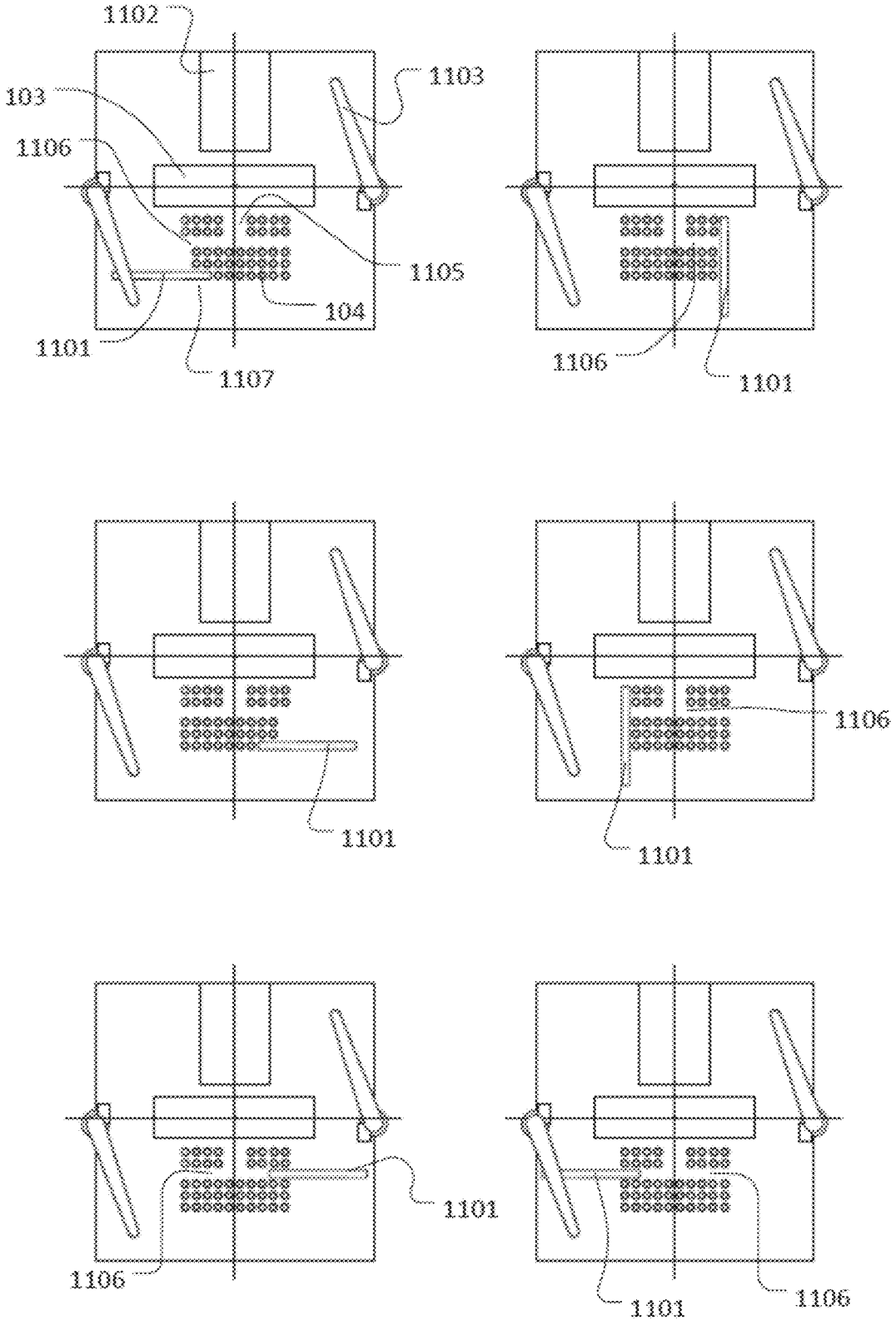
FIG. 11 schematically illustrates different examples of a deck layout of a drilling rig.

FIG. 11 schematically illustrates different examples of a deck layout of a drilling rig 100 where the maintenance/transfer position 1101 is positioned at different locations. The deck layout shows the position of the main mast 103 above the well centre, the riser bay 104, storage areas 1102 for drill pipes, deck cranes 1103, and the maintenance/transfer bay 1101. The given positions serve to illustrate examples, other variations may also apply. The deck cranes

1103 may e.g. be used for offloading/loading riser joints between the maintenance/transfer position 1101 and a supply vessel. As can be seen in FIG. 11, the riser joints are stored side by side, e.g. supported by fingerboards or another suitable arrangement. The storage positions are arranged such that they leave passageways 1106, 1105 allowing riser joints to be moved in upright orientation towards the well centre along passageway 1105 and towards the tilting position 1107 along passageway 1106. In particular, when the titling position is located in longitudinal extension of or at a longitudinal end of a straight passageway, the tilting of the riser joint is facilitated without interfering with other, stored riser joints.

Figure 12:
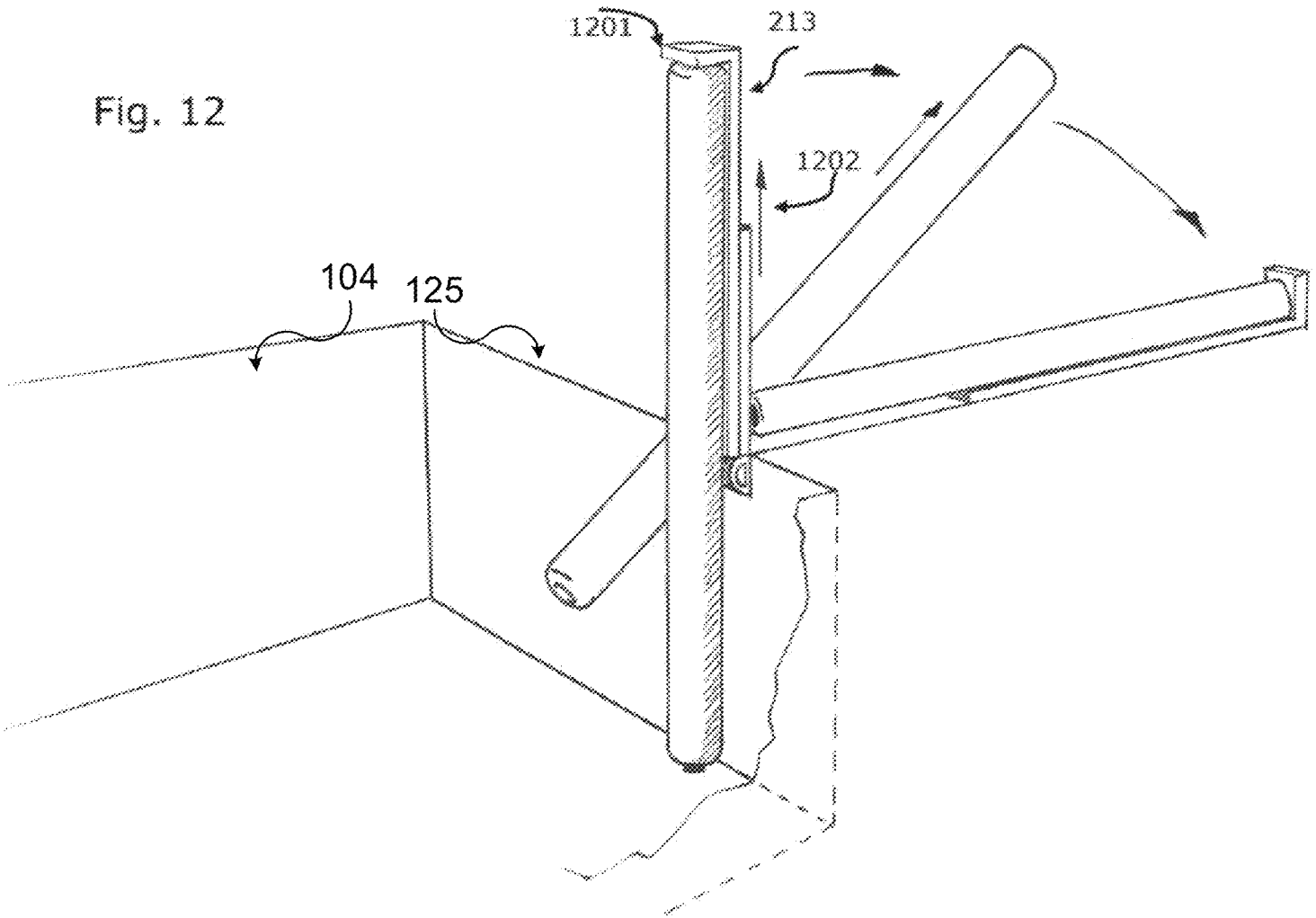
FIG. 12 shows another example of a riser tilting apparatus.

FIG. 12 shows an example of a riser tilting apparatus similar to that of FIG. 2. However in this case the elongated support member 213 is extendable in the axial direction as shown by arrow 1202 so that the top mounting element 1201 can raise a riser joint mounted in apparatus. A lower mounting element (similar to the mounting element 215, not shown) is optional but can be arranged to follow the riser joint upwards as the support member extends. Alternatively the elongated support is telescopic and optionally without the lower mounting. This has the effect that the pivoting point is moved downwards relative to and along the riser joint, causing the riser joint to extend further away from the bay when placed in the horizontal position in the maintenance/transfer bay. This may for example provide a clearer path for lifting a riser in and out of the riser/maintenance bay.

Generally, the force needed to raise the riser and the support can be supplied by the apparatus e.g. via a lifting cylinders or a pulley system arranged to extend or contract the support member 215. In some embodiments all or a part of the external force may be applied by an overhead crane e.g. coupled to the top mounting element 1201. In this way a mechanically simple device is achieved.

Figure 13:
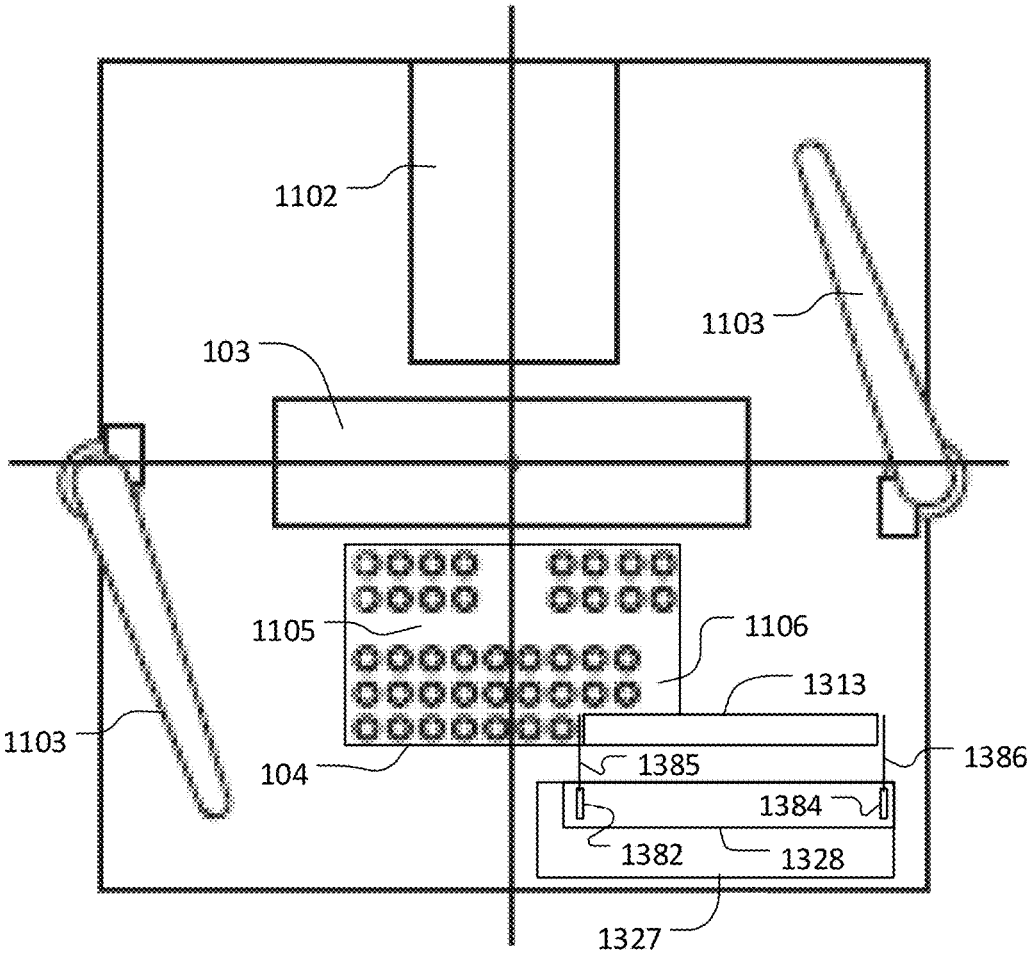
FIG. 13 shows another example of a riser tilting apparatus and a riser maintenance station.

FIG. 13 shows another example of a deck layout of a drilling rig comprising a riser tilting apparatus and a riser maintenance station. The deck layout of FIG. 13 is similar to one of the deck layouts shown in FIG. 11. The drilling rig comprises a main mast 103 above the well centre, a riser bay 104, storage areas 1102 for drill pipes, deck cranes 1103, an accommodation structure 1327, and a riser tilting apparatus 1313. The given positions serve to illustrate examples, other variations may also apply. The deck cranes 1103 may e.g. be used for offloading/loading riser joints between the tilting apparatus 1313 and a supply vessel. The riser bay is recessed below the level of the main deck. The riser joints are stored side by side, e.g. supported by fingerboards or another suitable arrangement. The storage positions are arranged such that they leave passageways 1106, 1105 allowing riser joints to be moved in upright orientation towards the well centre along passageway 1105 and towards the tilting position along passageway 1106.

The riser tilting apparatus may be of the type shown in FIG. 2 or FIG. 12. When the riser tilting apparatus is tilted into its horizontal position, the riser tilting apparatus is positioned alongside the accommodation structure 1327. The accommodation structure may e.g. be a building having two or more floors and be configured to provide accommodation for personnel, work areas and or storage areas, and/or the like. In this embodiment, the accommodation structure 1327 comprises a riser maintenance shop 1328 located on the same level as the main deck. The riser maintenance shop 1328 comprises a lateral opening (which may be closed by gates or the like) allowing a riser joint to be moved between the riser tilting apparatus 1323 and the maintenance shop 1328. To this end, mounting elements 1382 and 1384 and/or a riser bed may be movably arranged, e.g. on skid beams 1385 and 1386, between a position adjacent the riser tilting apparatus and a position inside the maintenance shop 1328.

Figure 14A:
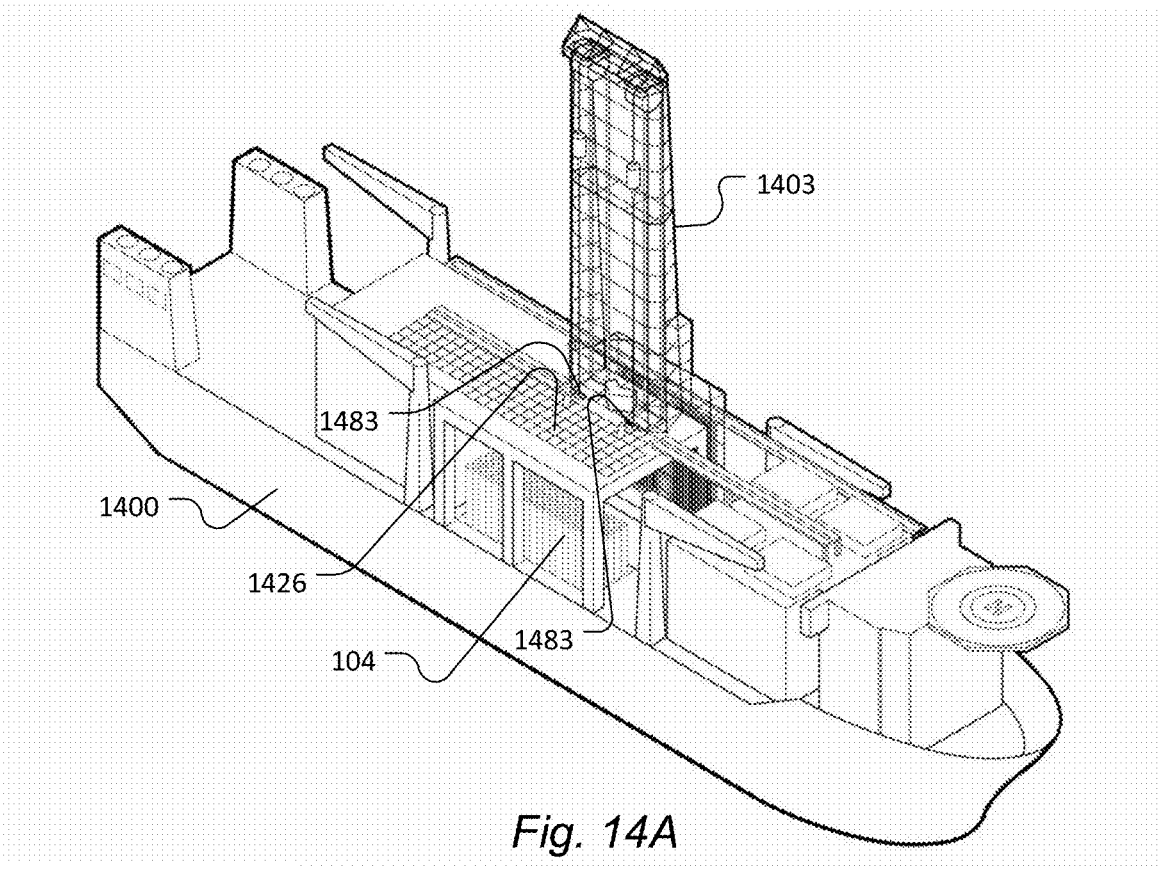
FIGS. 14A-B show an example of a drillship comprising a riser tilting apparatus and a riser maintenance station.

FIG. 14A shows an example of a drill ship comprising a drill floor 1426 with two well centres 1483 and a dual activity mast 103 for lowering a drill string through one or both of the well centres. The drillship further comprises a riser bay 104 for storing marine riser joints. As in the previous examples, the riser bay may be recessed below the level of the main deck. The riser joints may be stored side by side, e.g. supported by fingerboards or another suitable arrangement. The riser joints may be fed from the riser bay towards the respective well centres, e.g. by means of a gantry crane and respective chutes or other suitable pipe feeding equipment, e.g. through holes in the drill floor.

Figure 14B:
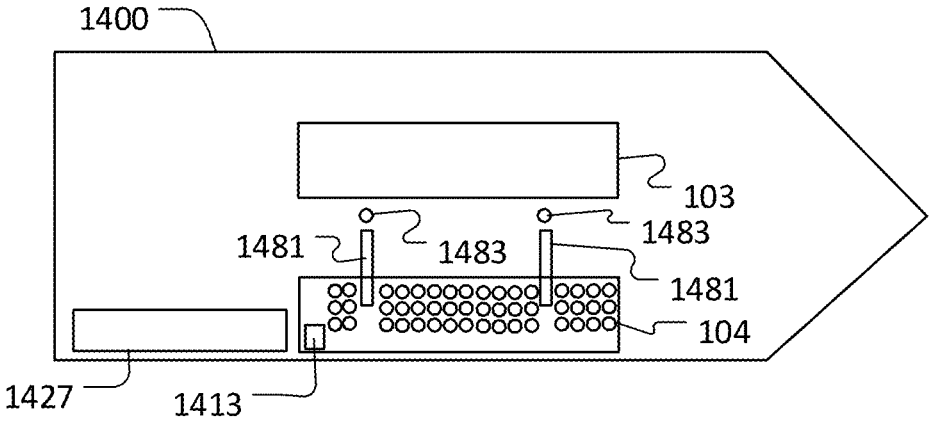

FIG. 14B schematically illustrates the drillship of FIG. 14A but where a riser tilting apparatus 1413 and a riser station 1427 for maintenance and/or for loading/offloading risers onto/from the drillship have been installed. It will be appreciated that a riser tilting apparatus 1413 and a riser station 1427 for maintenance and/or for loading/offloading risers onto/from the drillship may also be installed on other types of drill ships. The given positions of the riser tilting apparatus and the riser maintenance/loading bay serve to illustrate examples, other variations may also apply. For example, the riser maintenance/loading bay may be oriented along the longitudinal axis of the ship, as illustrated in FIG. 14, or along a transverse axis. Similarly, the maintenance/loading bay may be located fore or aft of the riser maintenance bay/loading and/or towards the port and starboard side of the ship. The riser tilting apparatus and/or the maintenance/loading bay may be oriented relative to the riser bay in a variety of ways, e.g. as described in connection with FIGS. 11 and 13. The riser tilting apparatus may be of the type shown in FIG. 2 or FIG. 12 and/or it may be positioned alongside or integrated into another structure, e.g. as described in connection with FIG. 13.

Although some embodiments have been described and shown in detail, the invention is not restricted to them, but may also be embodied in other ways within the scope of the subject matter defined in the following claims. In particular, it is to be understood that other embodiments may be utilised and structural and functional modifications may be made without departing from the scope of the present invention.

In device claims enumerating several means, several of these means can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A riser maintenance station for a drilling rig comprising:

a riser manipulation device including mounting elements configured to secure opposite ends of a riser, wherein the riser has a plurality of buoyancy elements secured thereto;

said mounting elements being configured such that the riser can be elevated to allow a 360 degree inspection along a length of the riser such that one or more of the buoyancy elements can be removed or attached from/to the riser while the riser is in a horizontal position at the riser maintenance station.

2. The riser maintenance station of claim 1, wherein the riser manipulation device is operable to elevate one or both ends of the riser while the riser is located in a horizontal position at the riser maintenance station.

3. The riser maintenance station of claim 1, wherein the riser manipulation device is operable to rotate the riser around its longitudinal axis while the riser is located in a horizontal position at the riser maintenance station.

4. The riser maintenance station of claim 1, wherein the riser maintenance station further comprises one or more riser maintenance machines operable to perform one or more maintenance operations on the riser.

5. The riser maintenance station of claim 1, wherein the riser maintenance station further comprises sandblasting equipment or riser inspection equipment insertable into the riser.

6. The riser maintenance station of claim 1, further comprising a protective enclosure shaped and sized to accommodate one or more risers in a prostrate position separated from each other so as to allow service personnel to access each of the one or more risers from both lateral sides of the riser.

7. The riser maintenance station of claim 6, wherein the enclosure is a housing completely enclosing the riser.

8. The riser maintenance station of claim 6, wherein the enclosure is a structure that encloses the circumference of the riser but that has one or two open ends, or ends covered by doors.

9. The riser maintenance station of claim 6, wherein the enclosure comprises an access opening roof or wall to allow risers to be moved into and out of the enclosure.

10. The riser maintenance station of claim 7, wherein the enclosure comprises an access opening roof or wall to allow risers to be moved into and out of the enclosure.

11. The riser maintenance station of claim 8, wherein the enclosure comprises an access opening roof or wall to allow risers to be moved into and out of the enclosure.

12. The riser maintenance station of claim 8, further comprising a riser bay.

13. The riser maintenance station of claim 1, wherein said mounting elements and bed being configured such that the riser can be rotated to allow a 360 degree inspection of the riser.

14. A riser maintenance station for a drilling rig comprising:

a riser manipulation device including mounting elements configured to secure opposite ends of a riser, wherein the riser has a plurality of buoyancy elements secured thereto;

the riser manipulation device further including a bed for supporting the riser in a horizontal position;

wherein the riser manipulation device is operable to move the riser longitudinally while the riser joint is located in a horizontal position at the riser maintenance station.

15. The riser maintenance station of claim 14, wherein the riser manipulation device is operable to move the riser longitudinally and laterally while the riser is located in the horizontal position at the riser maintenance station.

16. The riser maintenance station of claim 14, wherein the riser manipulation device further includes a bed for supporting the riser in a horizontal position.

* * * * *